US008511215B1

(12) United States Patent
Tervola et al.

(10) Patent No.: US 8,511,215 B1
(45) Date of Patent: Aug. 20, 2013

(54) PERSONAL PROTECTION SHIELD

(71) Applicant: Tactical Revolution, LLC, Jupiter, FL (US)

(72) Inventors: Timo Olavi Tervola, Palm Beach Gardens, FL (US); Sean Richard Rosario, Coral Springs, FL (US); Gerald David Benjamin, Jupiter, FL (US)

(73) Assignee: Tactical Revolution, LLP, Jupiter, FL (US)

( * ) Notice: Subject to any disclaimer, the term of this patent is extended or adjusted under 35 U.S.C. 154(b) by 0 days.

(21) Appl. No.: 13/675,409

(22) Filed: Nov. 13, 2012

Related U.S. Application Data

(60) Provisional application No. 61/560,285, filed on Nov. 15, 2011.

(51) Int. Cl.
*F41H 5/08* (2006.01)

(52) U.S. Cl.
USPC ..... 89/36.06; 89/36.03; 89/37.07

(58) Field of Classification Search
USPC ..... 89/36.06, 36.03, 37.07
See application file for complete search history.

(56) References Cited

U.S. PATENT DOCUMENTS

| | | | | | |
|---|---|---|---|---|---|
| 295,013 | A | * | 3/1884 | Hunter | 89/36.06 |
| 1,244,679 | A | | 10/1917 | Winn, Jr. et al. | |
| 1,279,930 | A | * | 9/1918 | Stroud | 89/36.06 |
| 1,320,888 | A | | 11/1919 | Miller et al. | |
| 2,215,204 | A | | 9/1940 | Young | |
| 2,306,708 | A | * | 12/1942 | Mendel | 42/106 |
| 3,983,832 | A | * | 10/1976 | Kinder | 440/12.63 |
| 4,358,984 | A | * | 11/1982 | Winblad | 89/36.08 |
| 5,703,318 | A | * | 12/1997 | Franchino et al. | 89/37.07 |
| 7,404,352 | B1 | | 7/2008 | Hoffman | |
| 2011/0056366 | A1 | | 3/2011 | Ran | |

* cited by examiner

*Primary Examiner* — Michelle Clement
(74) *Attorney, Agent, or Firm* — Foley & Lardner LLP

(57) ABSTRACT

A personal protection shield for use with a weapon, such as a firearm, may be used to protect the operator of the weapon. The shield may include one or more ballistic plates and one or more mounting assemblies to mount a ballistic plate to the weapon.

23 Claims, 46 Drawing Sheets

PERSONAL PROTECTION SHIELD

CONTINUITY DATA

The present application claims priority to U.S. Provisional Application No. 61/560,285 filed Nov. 15, 2011, the entirety of which is hereby incorporated by reference.

BACKGROUND

The present disclosure relates generally to the field of defensive equipment. The present disclosure relates more specifically to a shield system providing ballistic protection to a user.

Modern warfare has given rise to various attempts to better protect a user from projectiles and other hazards. For example, soldiers, police officers, and other personnel in a combat area may wear body armor. Such body armor may incorporate high strength materials such as Kevlar, steel, or ceramics to absorb the impact of bullets and shrapnel that may wound or even kill the wearer. The level of protection provided by body armor generally depends on the amount of protective material used. For example, the U.S. National Institute of Justice rates body armor based on its ability to stop different types of ammunition. Under this rating system, ratings vary from Type IIA body armor, which is capable of protecting against low-power calibers such as 9 mm Luger rounds, up to Type IV body armor, which is capable of protecting against armor piercing rifle calibers, such as .30-06 Springfield armor piercing rounds.

As the level of protection provided by body armor increases so does the weight of the body armor, since more high strength material is used. In addition, the high strength material used in modern body armor has very little flexibility. As a result, greater protection of a user of body armor comes at the expense of the user's mobility. Thus, a tradeoff is often made in the design of body armor to protect only vital areas of the wearer. For example, the body armor may protect the wearer's torso or groin area, while the wearer's head and limbs are left unprotected to afford greater mobility to the wearer.

Body armor that protects a wearer's torso is only effective when the wearer's torso is exposed to hostile projectiles. For example, a soldier facing enemy fire may have a certain amount of protection while in a standing or kneeling position around his torso. However, his face and limbs may still remain unprotected. In addition, body armor may have minimal to no effect when the wearer is in other body positions, such as when laying in the prone position. The wearer may get into such a position to initiate or return fire (e.g., a sniper may shoot at an enemy target from the prone position). The inventors have discovered that there may be a need for a system that better protects a user when not in an upright position, such as when firing a weapon from the prone position, while still affording the user greater mobility.

SUMMARY

One embodiment of the disclosure relates to a personal protection shield for use with a firearm having a barrel. The personal protection shield includes a ballistic plate and a mount. The mount includes a first portion configured to be attached to the firearm substantially parallel to the barrel and a second portion configured to rotate between a retracted position and an extended position about an axis that is substantially perpendicular to the barrel. A side of the second portion is substantially parallel to the barrel in the retracted position. The ballistic plate is configured to be releasably coupled to the second portion.

Another embodiment relates to a personal protection shield for a firearm having a barrel. The shield is releasably attached to a barrel rail assembly, which includes an aperture configured to receive the barrel of the firearm, wherein the barrel rail assembly further includes opposing first and second barrel rails. The shield further includes a first ballistic plate and a first mount configured to releasably attach to the first barrel rail and configured to releasably couple with the first ballistic plate. The shield further includes a second ballistic plate and a second mount configured to attach to the second barrel rail and configured to releasably couple with the second ballistic plate.

Another embodiment relates to a mount for a personal protection shield for a firearm having a barrel. The mount includes a first portion configured to engage a barrel rail substantially parallel to the barrel of the firearm and configured to attach to the barrel rail by applying compressive force to opposing ends of the barrel rail. The mount includes a second portion configured to rotate between a retracted position and an extended position about an axis that is substantially perpendicular to the barrel, wherein a side of the second portion is substantially parallel to the barrel when in the retracted position, and wherein the second portion includes a plate rail configured to engage a panel rail retainer of a ballistic plate.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
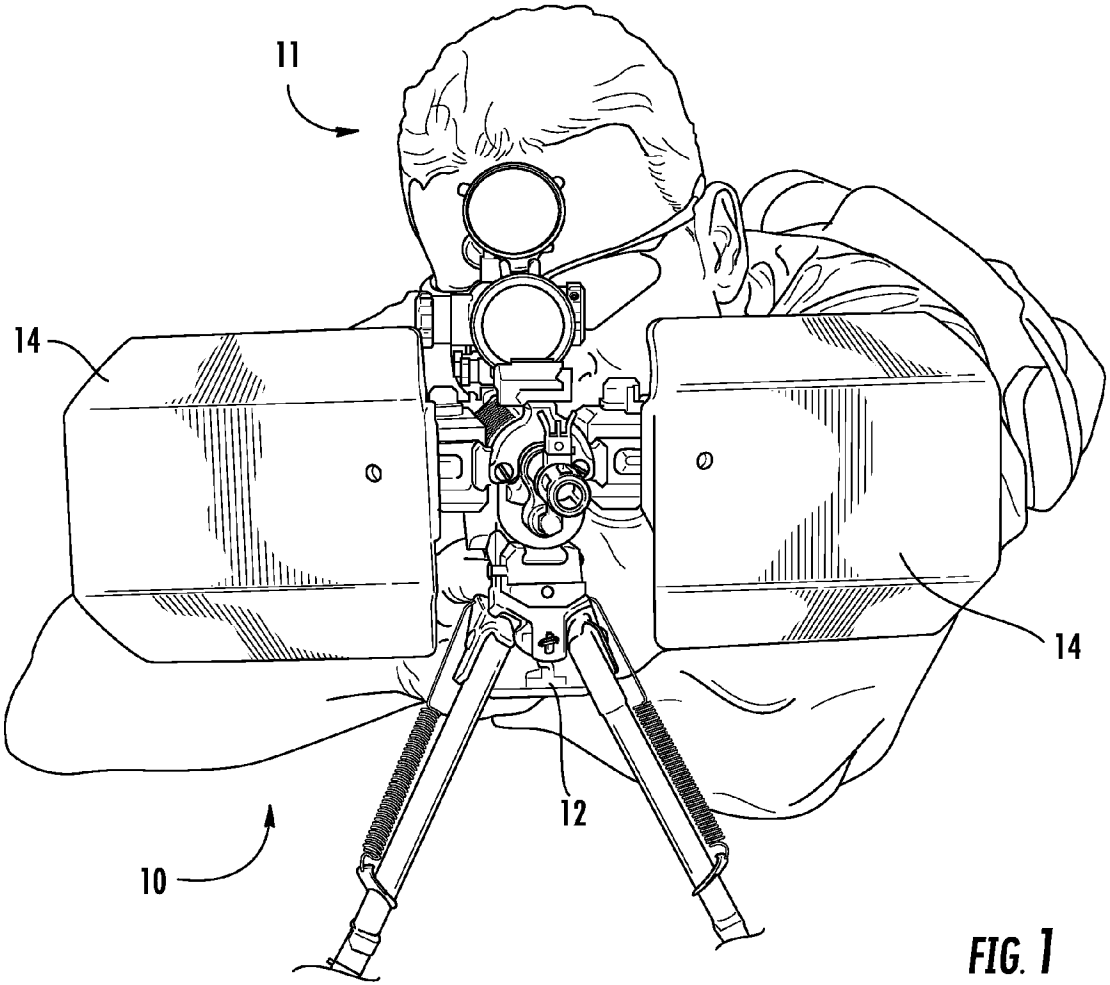
FIG. 1 is a perspective view image of a personal protection shield attached to a weapon being used by a prone user according to an exemplary embodiment.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

According to various embodiments described herein, a personal protection shield may include one or more ballistic panels, such as those used in body armor, that may be mounted to a weapon or other object to afford protection to the user while in positions such as the prone position. The shield may include two major components, a quick attach and quick detach (QA/QD) weapon mount and one or more QA/QD ballistic panels. The weapon (e.g., a firearm or other object) mount may be attached to or detached from the weapon with or without the ballistic plate or panel at any time, and the ballistic plate can also be attached to or detached from the weapon mount at any time. The ballistic plate may also serve a multi-purpose role as a stand-alone plate insert for a body-worn armor, such as a vest. This allows the weapon to be utilized without the shield when desired (e.g., when the user is upright). This also allows the ballistic plate to serve as both an attachment to the shield system or as a stand-alone insert plate for body armor, allowing the user to prioritize the way the plate is used. For example, when the user is not engaged in a firefight or is upright, the plate may be worn on the body, reducing the amount of weight the user's arms have to support by carrying the weapon. If combat is initiated suddenly, the user may remove the plate from the vest and attach it to the weapon mount to have additional "effective" ballistic protection when engaging an enemy from a prone position. When engagement is over, the panel may be removed and reinserted into the vest, affording the user protection again while upright. Since the plate has multiple uses, it minimizes the amount of additional weight the user has to carry, affording the user greater mobility in the field. If any component of the shield is damaged, it can be quickly replaced in the field due to the QA/QD nature of the components.

The system may provide ballistic protection and enhance user survivability from projectiles, such as bullets and shrapnel. The system may be capable of defeating or protecting against, for example, a Level III U.S. Military designated projectile such as an "M80" or a Level IV U.S. Military designated projectile such as an "M2AP." The system may be useful in areas where natural or manmade cover is minimal and exposure to incoming projectiles is imminent. In some embodiments, the system may have multi-hit capacity and may allow the user to direct effective fire downrange while being fired upon.

Referring generally to the Figures, a quick-attachable (QA) and quick-detachable (QD) shield is described that may be implemented in a system including the shield and a weapon (e.g., a firearm). The shield as described may be a weapon mounted ballistic shield or plate. In the figures, the shield is shown as a pair of ballistic plates or panels configured to be mounted on either side of the firearm. The mount or shield assembly generally includes the ballistic plate and a weapon mount for mounting the plates to the weapon, the weapon mount including a panel attachment swing-arm body, a flexor arm assembly, slide guides, and position-retention latches to lock the swing-arm body and flexor arm in the expanded position. The mount or shield assembly may also include clamps (top, middle, bottom) and a thumb-turn screw for efficient assembly attachment to a rail assembly. The mount or shield assembly may also include a position retention latch to lock the swing-arm body and flexor arm in the closed position.

Referring now to FIG. 1, a perspective view image of a personal protection shield 10 being used by a prone user 11 is shown, according to an exemplary embodiment. As shown, user 11 may operate a weapon 12 (e.g., a firearm, a grenade launcher, etc.) to engage an enemy target from a prone position. Attached to weapon 12 is a personal protection shield 10 that provides protection to the user 11. The shield 10 may include one or more plates 14 that provide protection to user 11 by deflecting projectiles away from user 11 and are configured to provide cover for user 11 of the weapon 12. The plates 14 provide cover for the upper torso, neck, and head area of user 11 from projectiles, which would otherwise be exposed while user 11 is in the prone position. In various embodiments, the plates 14 may provide cover to user 11 while in the prone position as depicted in FIG. 1, or may be configured to provide cover when the user 11 is in any other position. For example, the user 11 may rest weapon 12 on a wall or embankment while the user 11 is in an upright position. In such a case, the shield 10 may still protect the head, arms, and shoulders of user 11. The plates 14 may also be mounted in various ways on the weapon 12 based on the position of the user 11 and the direction in which the weapon 12 and shield 10 is directed. Thus, the plates 14 may be mounted to provide cover to any part of the body.

The shield 10 may be mounted on the weapon 12 such that it does not interfere with operation of the weapon 12 or obstruct the effective line of sight down-range of user 11. Furthermore, the shield 10 may be snag-resistant due to its shape and smooth edges so the user 11 does not have issues with the shield 10 getting caught on something in the field. The shield also may be rapidly expandable and collapsible; when it is not required, it can be in the collapsed position, streamlining the components. The shield 10 may be configured to be fast and easy to expand.

Figure 2:
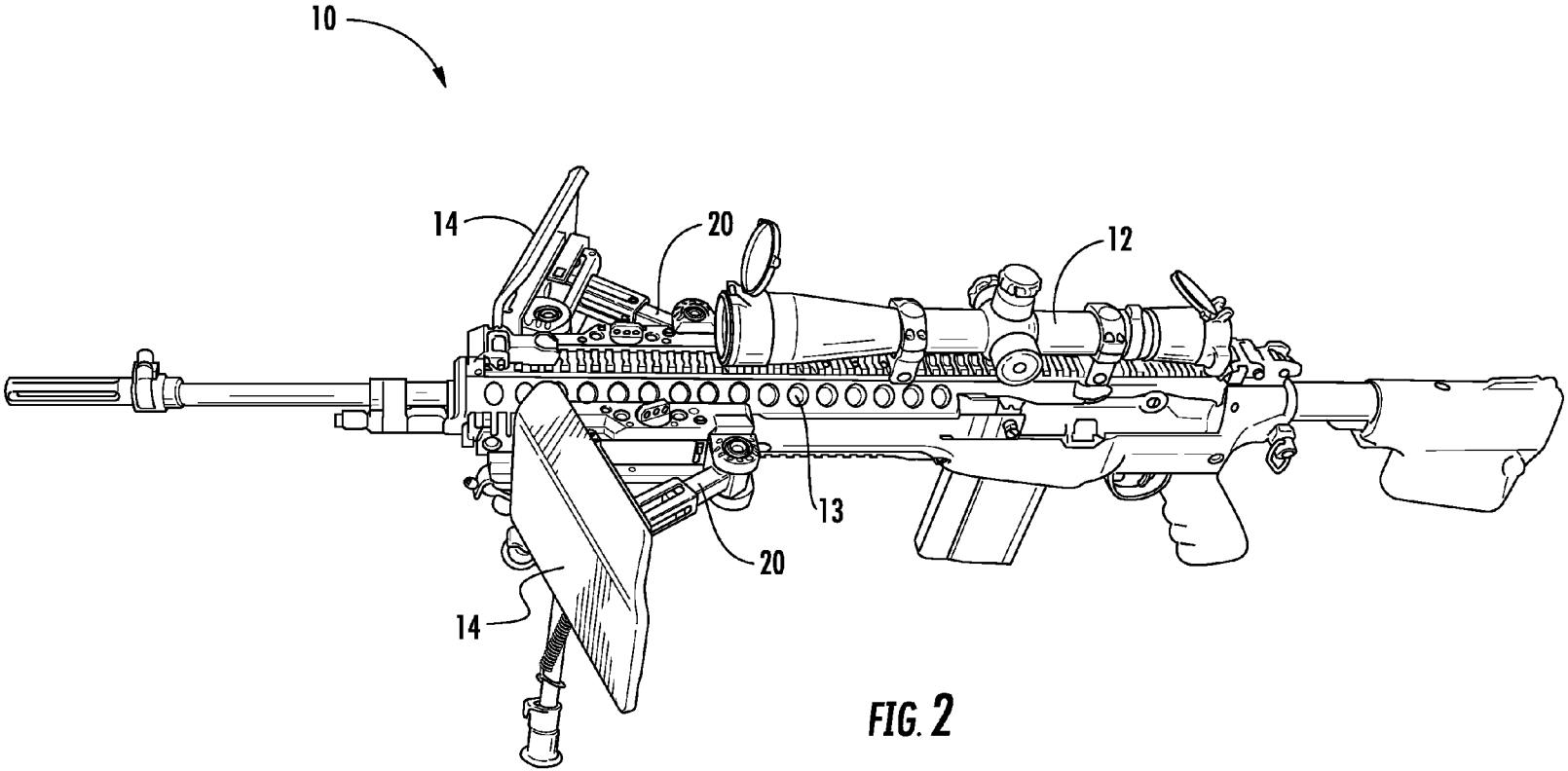
FIG. 2 is a side view image of the shield and weapon illustrated in FIG. 1, according to an exemplary embodiment.

Referring to FIG. 2, a side view image of the shield 10 and the weapon 12 illustrated in FIG. 1 is shown, according to an exemplary embodiment. As shown, the shield 10 assembly may be mounted to a barrel rail assembly 13 of weapon 12. In general, barrel rail assembly 13 may be fitted to the weapon 12 to encompass or at least partially surround the barrel of the weapon 12. Barrel rail assembly 13 may be in contact with the barrel of weapon 12 or may be a "free-floating" rail that only contacts weapon 12 where the barrel and receiver of weapon 12 meet. According to various embodiments, the barrel rail assembly 13 may have one, two, three, four, or any other number of barrel rails that run parallel to the barrel of weapon 12. For example, barrel rail assembly 13 may have four rails that may be used to mount a scope on the top rail, two shield assemblies on the side rails, and a flashlight or bipod on the bottom rail. According to some embodiments, barrel rail assembly 13 may have opposing barrel rails each for mounting one of plates 14 on opposing sides of the weapon 12. In some embodiments, a shield mount assembly 20 may engage a barrel rail of barrel rail assembly 13 and retain one of plates 14. In various alternatives, one plate and mount assembly may be used, two plates and two mount assemblies may be used, or three or more plates and mount assemblies may be used as part of the personal protection shield 10. For example, a third panel may extend upward from a top surface of the barrel rail assembly 13. In other alternatives, plates 14 may extend at other angles from the rail from the perspective of the user, for example at about forty-five degrees.

Figure 3:
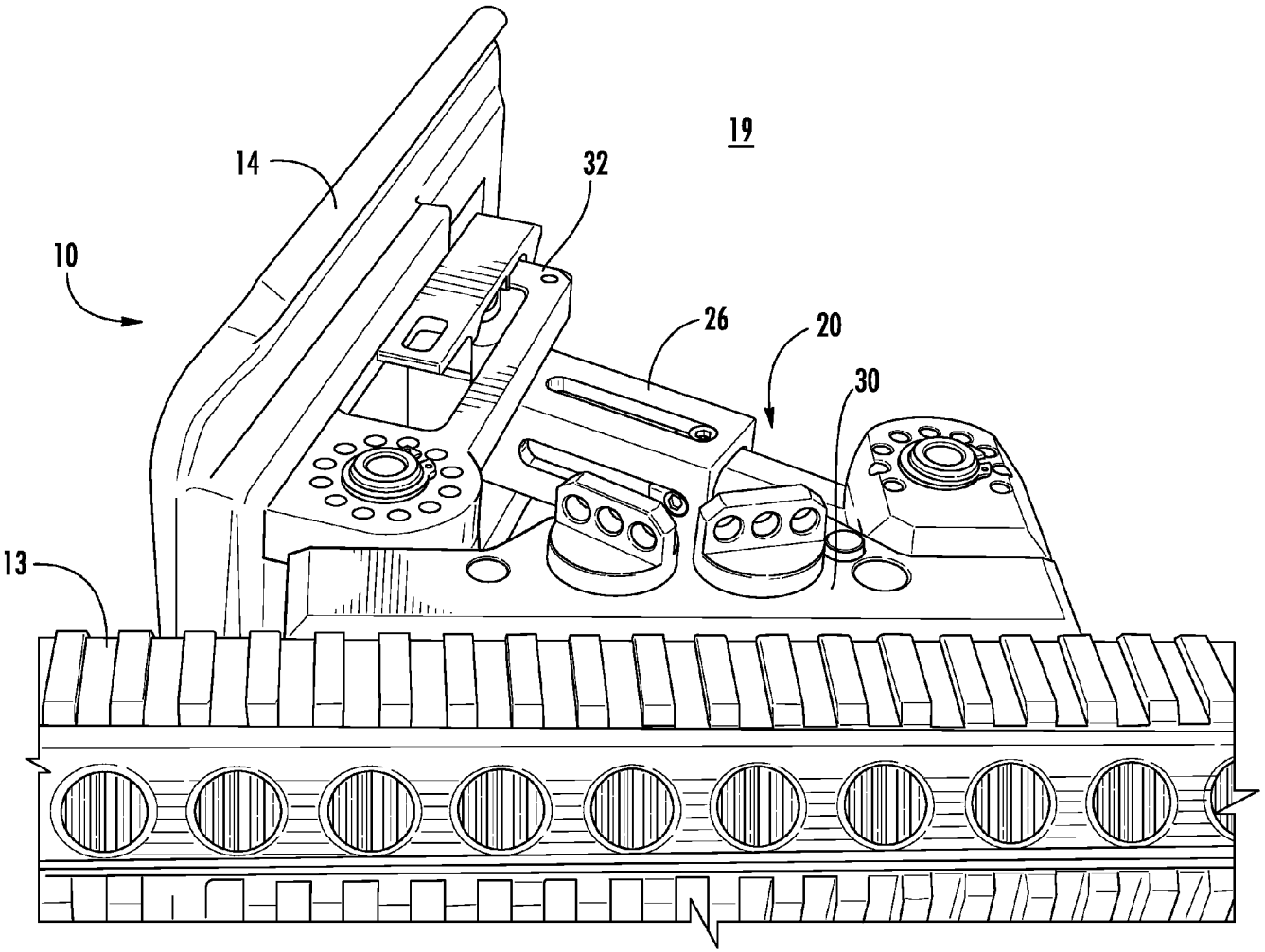
FIG. 3 is a perspective view image of a portion of the shield illustrated in FIG. 2 used with a debris panel, according to another exemplary embodiment.
Figure 4:
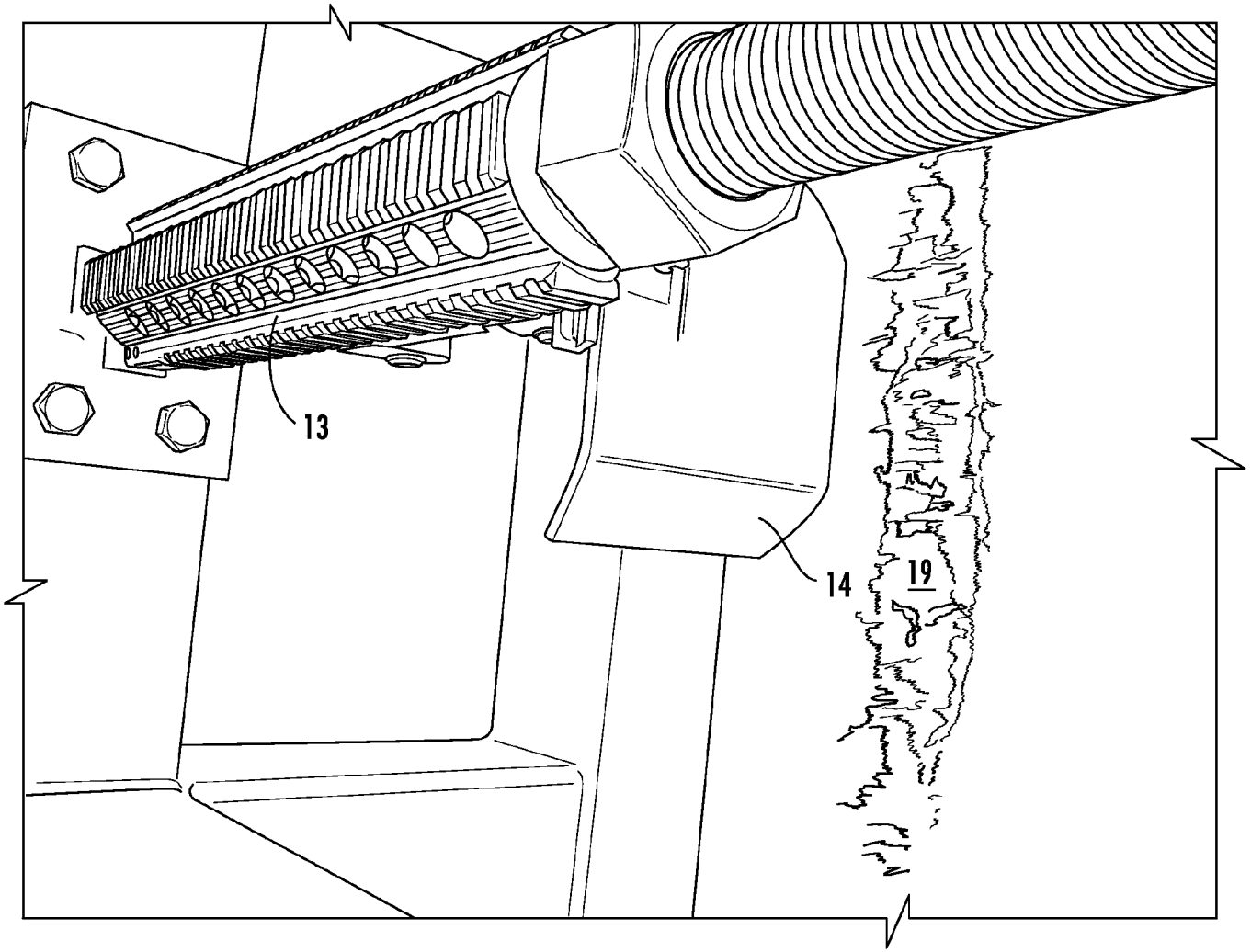
FIG. 4 is a perspective view image of a portion of the shield illustrated in FIG. 2 used with a debris panel, according to another exemplary embodiment.

Referring generally to FIGS. 3-4, perspective views of the shield 10 illustrated in FIG. 2 used with a debris panel are shown, according to various embodiments. In the examples shown, barrel rail assembly 13 is mounted to a testing rod that simulates barrel rail assembly 13 being mounted to weapon 12. One of the plates 14 is attached to the barrel rail assembly 13 via a shield mount assembly 20. The plate 14 of the shield 10 is held in place by a mount assembly 20 including a first portion 30 configured to releasably attach mount assembly 20 to a rail of rail assembly 13, a second portion 32 configured to releasably attach plate 14 to mount assembly 20, and a flexor arm assembly 26 connected to both the first portion 30 and the second portion 32 of mount assembly 20. The flexor arm assembly 26 may also incorporate a spring-loaded shock absorption system configured to deflect and absorb energy during impact of the projectiles on the plate 14.

In the direction parallel to the barrel rail assembly is also shown a plywood debris panel 19 in FIGS. 3-4. FIG. 3 shows a perspective view of the plywood debris panel 19 from the top of barrel rail assembly 13, while FIG. 4 shows a perspective view from the bottom of the barrel rail assembly 13. Debris and damage is shown on the plywood debris panel 19 off to the side of the armor plate 14 from actual testing of the deflection capabilities of the shield 10. According to an exemplary embodiment, the shield 10 is configured to drastically reduce trauma sustained by a user during ballistic impact scenarios. When a user is in a prone position, for example, areas that may otherwise be inadequately protected by body armor could be dangerously exposed to incoming projectiles. The disclosed shield 10 is designed to protect these areas by blocking and/or redirecting projectiles away from the user.

Figure 5A:
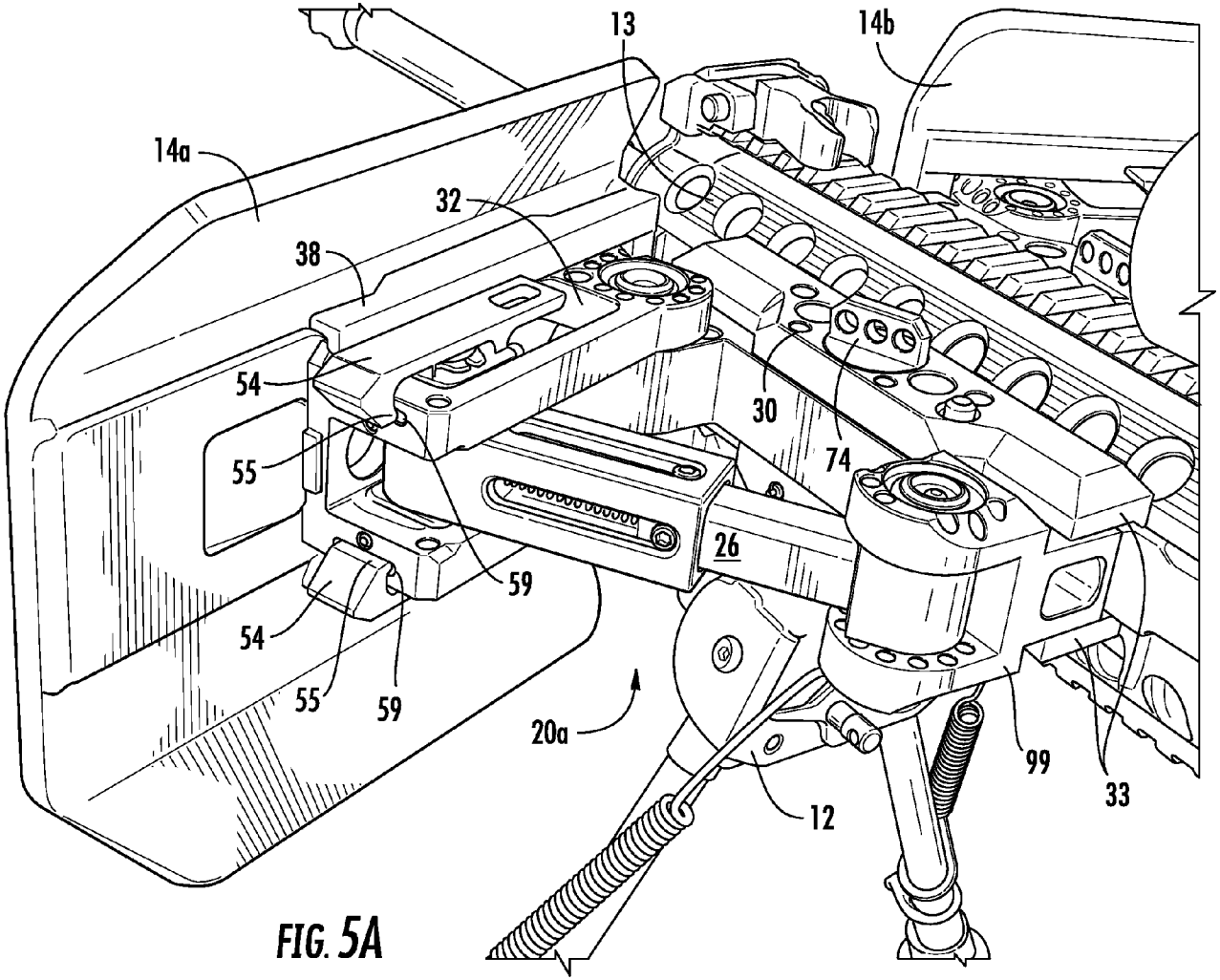
FIG. 5A-5B are perspective view images of a portion of the shield illustrated in FIG. 2 in an extended position, according to another exemplary embodiment.
Figure 5B:
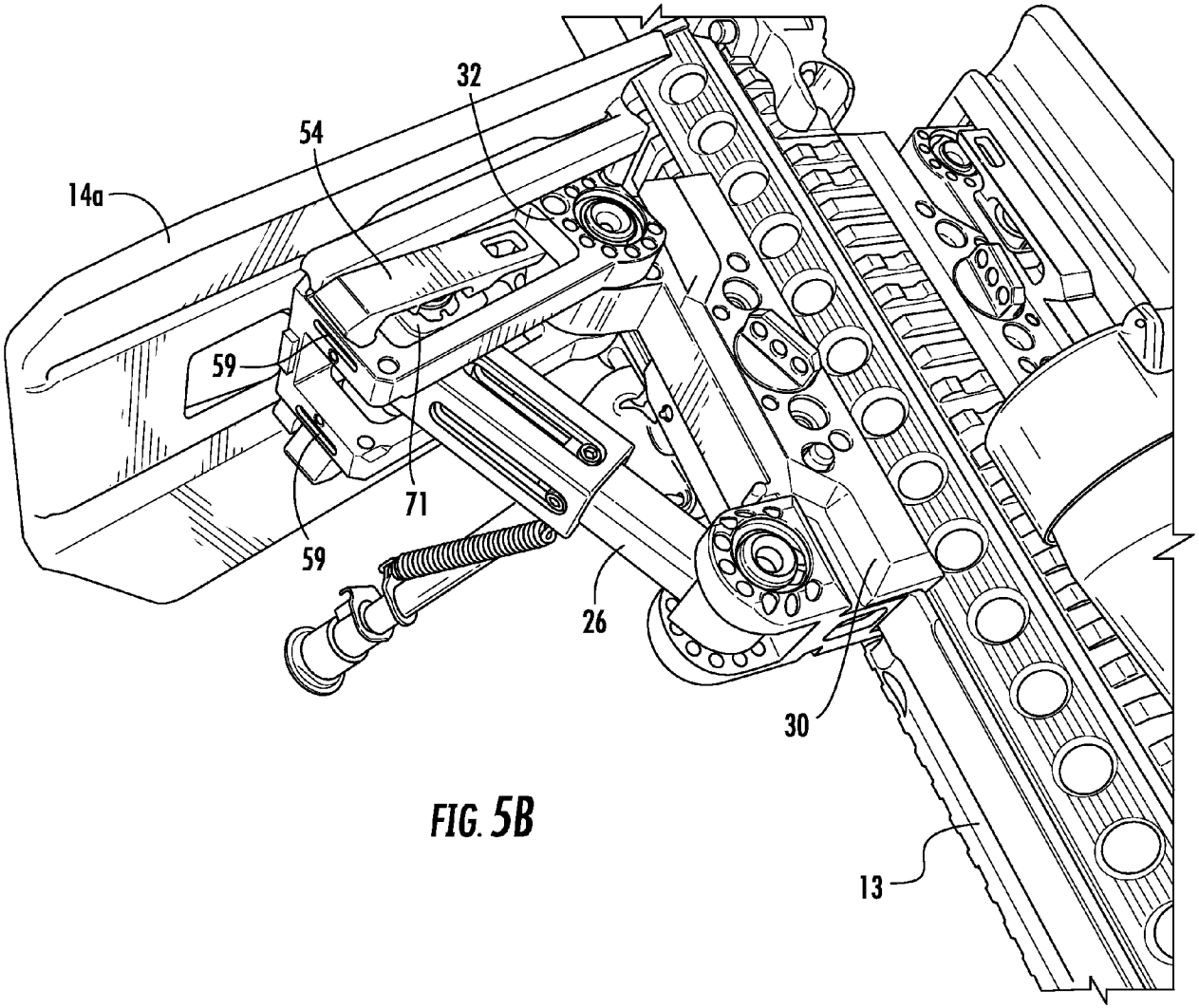
Figure 6:
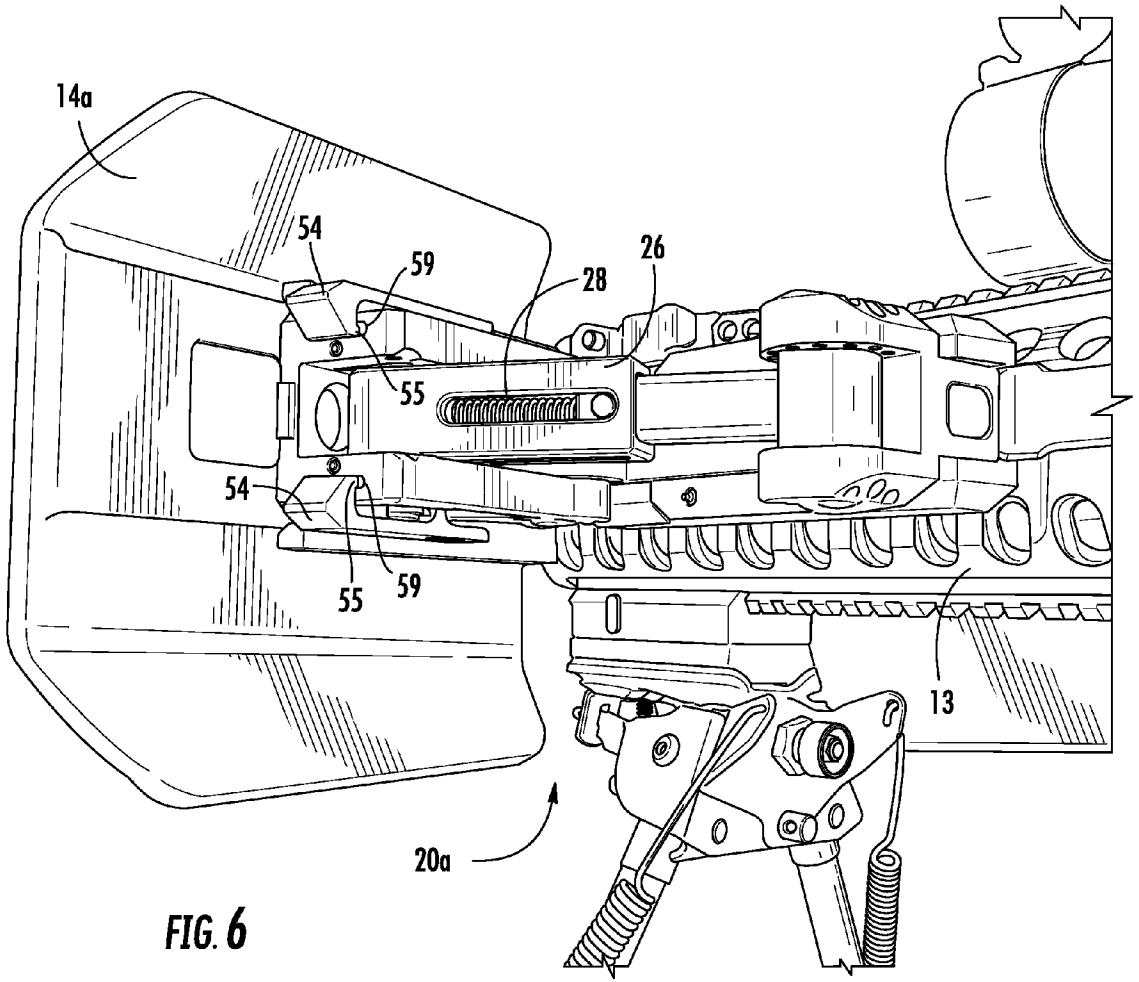
FIG. 6 is a perspective view image of the portion of the shield shown in FIGS. 5A-5B, according to another exemplary embodiment.

Referring generally to FIGS. 5A-5B and FIG. 6, a portion of the shield 10 is shown in the extended position, according to exemplary embodiments. In some embodiments, shield 10 includes left and right mounting assemblies 20 attached to opposing rails of barrel rail assembly 13 to protect the left and right side of the user, respectively. As described herein, the left plate is labeled 14*a*, the left mount assembly is labeled 20*a*, the right plate is labeled 14*b*, and the right mount assembly is labeled 20*b*. According to various embodiments, plates 14*a*-14*b* or mount assemblies 20*a*-20*b* may be configured specifically for mounting on the left or right rails of barrel rail assembly 13. In such cases, plates 14*a*-14*b* or mount assemblies 20*a*-20*b* may be mirror images of one another. For example, mount assemblies 20*a*-20*b* may be mirror images of one another, allowing their respective controls to be positioned upward when in use. Each of plates 14*a*-14*b* or mount assemblies 20*a*-20*b* may also be labeled to allow a user to quickly identify where to place plates 14 and mount assemblies 20 with respect to weapon 12. For example, mount assembly 20*a* may be labeled "L" to denote that mount assembly 20*a* is to be mounted on the left rail of barrel rail assembly 13. In further embodiments, plates 14 and mount assemblies 20 may be uniform, allowing them to be mounted on either side of barrel rail assembly 13. For example, a mount assembly 20 may have duplicate controls on opposing sides, allowing a user to always operate the controls from above, regardless of where the mount assembly is mounted on barrel rail assembly 13.

In FIGS. 5A-5B and FIG. 6, the back of the left plate 14*a* and portions of the left mount assembly 20*a* is shown, according to an exemplary embodiment. The plates 14 are shown installed at an angle not perpendicular to the barrel of weapon 12. According to an exemplary embodiment, when two plates are deployed on either side of the firearm, the plates provide the user with an effective downrange horizontal ballistic protection cone. In one embodiment, the range of protection may be thirty degrees. As a result, incoming fire originating within the cone can be deflected by the shield system. For example, at a distance of fifty feet, the protection cone is approximately thirty feet wide, and at a distance of one hundred and fifty feet, the protection cone is approximately eighty feet across.

The angle to which any of the plates 14 flexes out from the weapon may be, for example, about seventy degrees. Incoming fire coming from directly downrange may then impact the plates 14 at twenty degrees obliquity. Projectiles incoming from the far ends of the protection cone may impact at five degree obliquity with respect to the plates 14. This may ensure that the projectiles impacting the shield system do not impact dead-on. This may allow the projectile to deflect off the plates to various degrees, resulting in less energy transfer from the projectile to the shield 10. Referring briefly again to FIGS. 3-4, debris and damage is shown as deflected away from the weapon and user as a result of the angled plates 14. FIGS. 3-4 illustrate a post-impact projectile disintegration pattern, shown in the plywood debris panel 19 in the background. In one embodiment, the plates 14 are contoured and shaped to enhance deflection angles for incoming projectiles in addition to the angled offset of the plates 14 itself with respect to the weapon 12.

The combined effect of the aforementioned impact force reduction design features may reduce the force transferred into the user. Further, the plates 14 and other materials utilized in the shield 10 can reduce overall weight because there is less force to be dealt with; hence, less material is required for effective load transfer. For example, the mount assemblies 20 may be formed using aluminum, titanium, a scandium-titanium alloy, or another lightweight material capable of withstanding the transferred force from one of the ballistic plates 14. In general, a lightweight mount assembly may allow the mount assemblies 20 to remain affixed to the barrel rails of the firearm during transport, when the ballistic plates are removed. According to various embodiments, the combined weight of the two mount assemblies on either side of the weapon 12 may be less than seven pounds, less than five pounds, less than four pounds, less than three pounds, or less than two pounds.

Referring again to FIGS. 5A-5B and FIG. 6, mount assembly 20*a* is shown in the extended position. The first portion 30 may be releasably attached to a rail of barrel rail assembly 13 via any number of different release means such that first portion 30 is substantially parallel to the barrel when attached to barrel rail assembly 13. As shown, first portion 30 may include three components: top and bottom barrel rail retainers 33 and a primary body 99 in between barrel rail retainers 33. When locked into position on barrel rail assembly 13, barrel rail retainers 33 may apply compressive force to opposing ends of the barrel rail. In some embodiments, the barrel rail retainers 33 may slidably engage the barrel rail assembly 13. According to other embodiments, the barrel rail retainers 33 may utilize a QA/QD mechanism, allowing the barrel rail retainers 33 to be attached to a rail of the barrel rail assembly 13 without sliding mount assembly 20*a* onto the rail. For example, the top portion, bottom portion, or both portions of the barrel rail retainers 33 may be spring-loaded, allowing the barrel rail retainer 33 to be directly clamped onto a rail of the barrel rail assembly 13. In some embodiments, the barrel rail retainers 33 may include one or more controls (e.g., knobs, screws, etc.) that can be used to lock or unlock the barrel rail retainers 33 onto the barrel rail assembly 13 after being clamped to the barrel rail assembly 13. In various embodiments, first portion 30 may include one or more thumb screws 74 to regulate the amount of compressive force applied to the rail of barrel rail assembly 13. In other embodiments, barrel rail retainers 33 may be spring loaded such that force applied to the distal end of the barrel rail retainers 33 away from barrel rail assembly 13 causes barrel rail retainers 33 to disengage the rail.

Mount assembly 20*a* may include a second portion 32 configured to rotate between a retracted position and an extended position about an axis that is substantially perpendicular to the barrel of the weapon to which it is attached. When the second portion 32 is in a retracted position (e.g., the assembly is in a collapsed position), the side of the second portion 32 is substantially parallel to the barrel. The ballistic armor plate 14*a* may be configured to be releasably coupled to the second portion 32 using any of a number of different releasable engaging mechanisms. For example, the releasable engaging mechanism may be configured to allow attachment and detachment of the plate 14*a* to the mount without requiring a tool, without requiring a separate fastener, with the use only of the user's hands, and/or with other configurations or characteristics. In some embodiments, ballistic plate 14*a* may include a locking mechanism as part of the armor plate retainer 38 that locks the ballistic plate 14*a* into place on the second portion 32 of the shield mount. Thus, a user of shield 10 may remove plate 14*a* from mount assembly 20*a* and use plate 14*a* as part of the user's body armor (e.g., as a ballistic plate within a protective vest).

While mount assembly 20*a* is being extended, the flexor arm assembly 26 may slide within the second portion 32 away from the barrel rail assembly 13 and be retained by one or more locking mechanisms (e.g., a clip, a bolt, a pin, a latch, a detent mechanism, etc) upon reaching the extended position. For example, the flexor arm assembly 26 may include one or more clips 54 configured to releasably engage the second portion 32 when mount assembly 20*a* is in the extended position. In one embodiment, the clips 54 may include a "tooth" 55 (or other end) that mates with grooves 59 in the second portion 32. The clip 54 and tooth 55, when engaged with the corresponding groove 59, may lock the flexor arm assembly 26 assembly in place (e.g., by locking slide guide 71 in place) when the mount is in an expanded position and the shield 10 is in use. When the clips 54 are disengaged, this allows the mount assembly 20*a* to be returned to a collapsed position by sliding slide guide 71 and flexor arm assembly 26. As shown in more detail in FIG. 6, the flexor arm assembly 26 may also include a shock absorber 28. When mount assembly 20*a* is locked in the extended position, the shock absorber 28 of the flexor arm assembly 26 absorbs part of the force transferred during impact to the ballistic plate 14*a*.

Figure 7:
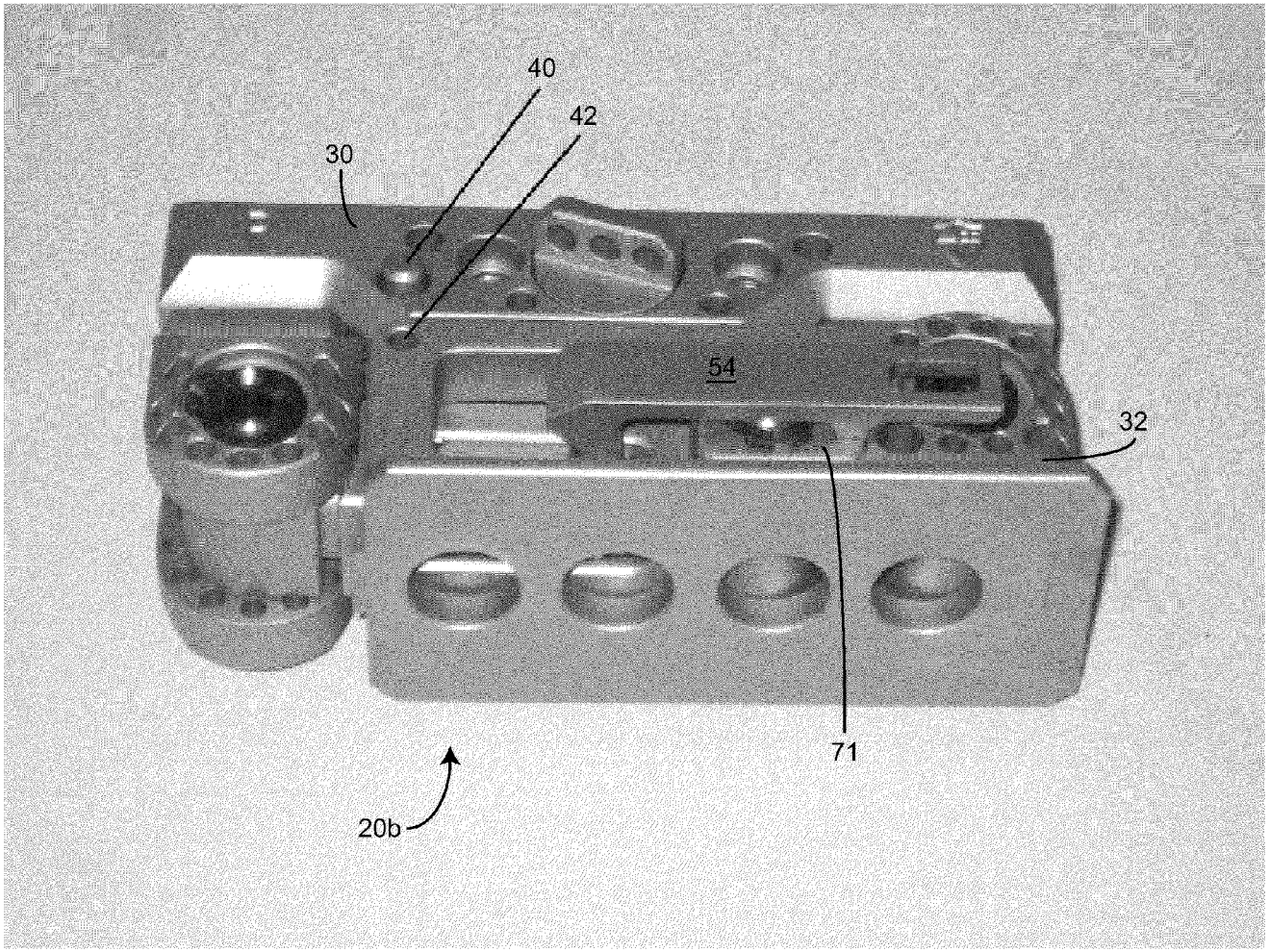
FIG. 7 is a perspective view image of a mount assembly of the shield illustrated in FIG. 2 in a collapsed position, according to another exemplary embodiment.
Figure 8:
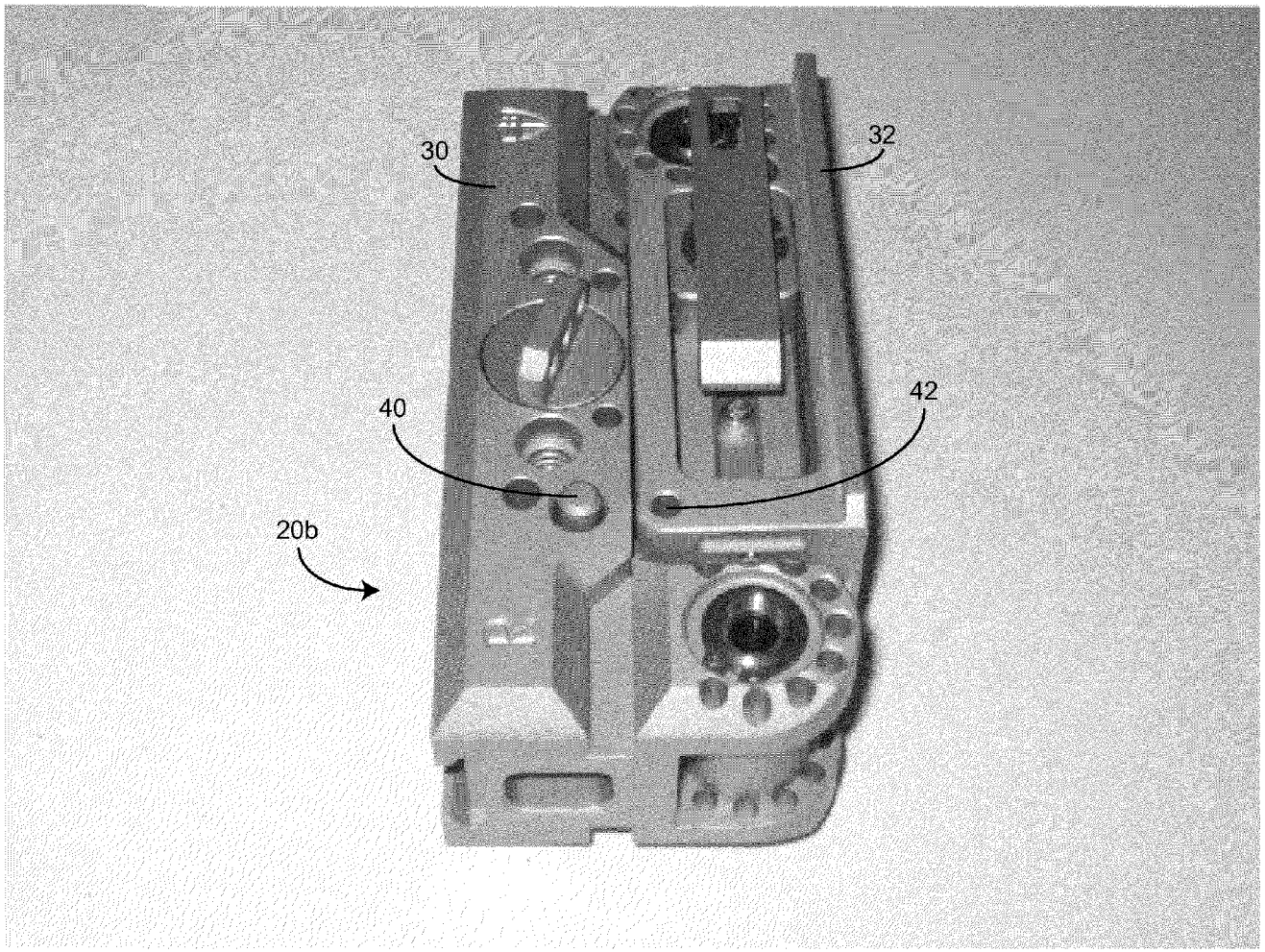
FIG. 8 is another perspective view image from a second side of the mount assembly shown in FIG. 7, according to another exemplary embodiment.
Figure 9:
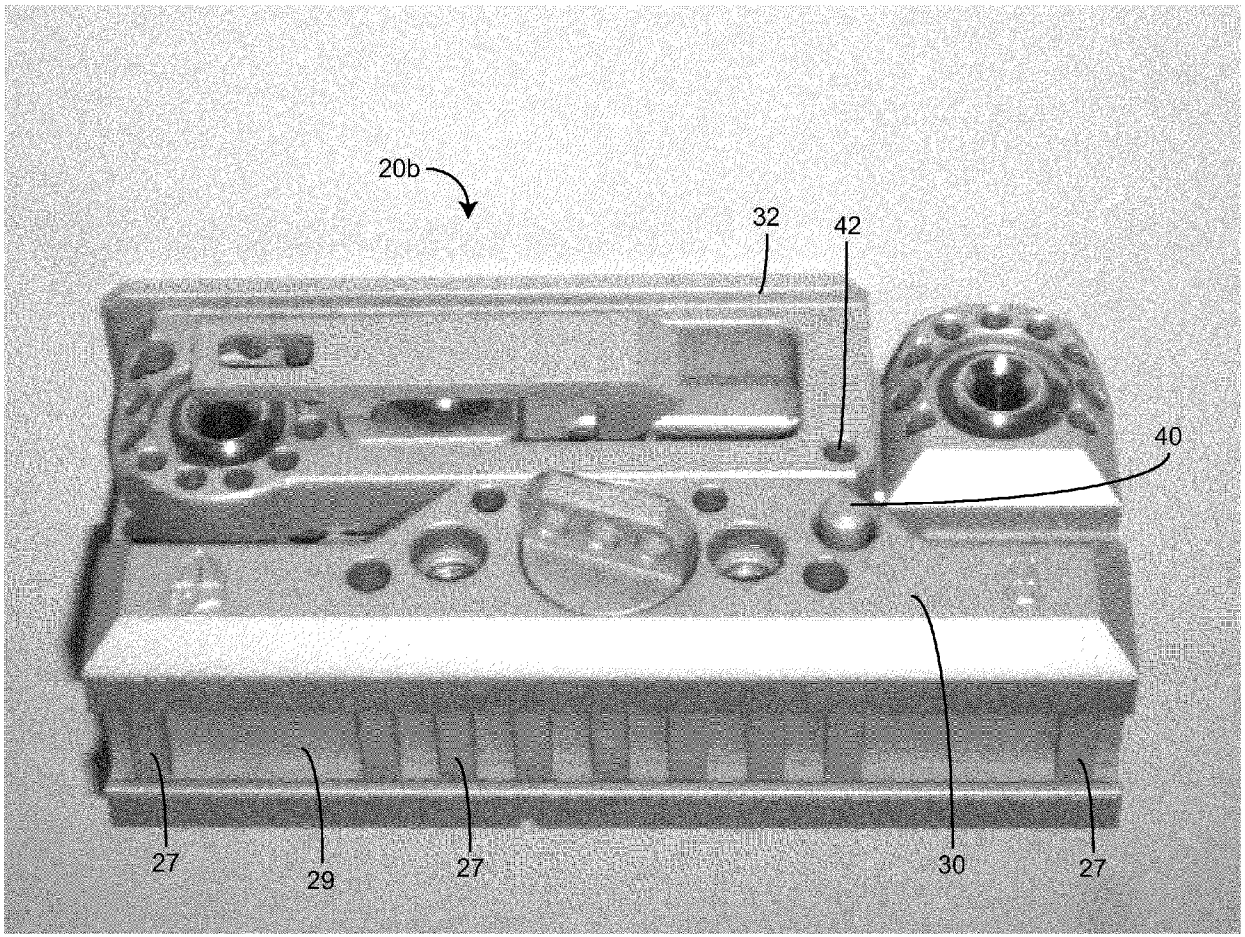
FIG. 9 is a perspective view image from a third side of the mount assembly illustrated in FIGS. 7-8 in a collapsed position, according to another exemplary embodiment.

Referring generally to FIGS. 7-9, perspective views of the mount assembly 20*b* in its collapsed position are shown in greater detail, according to exemplary embodiments. As shown, mount assembly 20*b* in its collapsed mode may be held in position with a spring loaded locking/release arm, according to an exemplary embodiment. Such an apparatus is shown in greater detail in, for example, FIGS. 10A and 28. The mount assembly 20*b* is shown to include a release button 40 (e.g., a latch) for opening the mount assembly 20*b* from its collapsed mode into its extended mode. The release button 40 may be a quick open or quick close latch that upon operation, opens or closes the mount assembly 20*b*. The hole 42 may be a quick open or quick close latch engagement hole that upon operation, opens or closes the mount assembly 20*b* or releases the release button 40. The release button 40 is shown on the first portion 30 of the mount assembly 20*b* and the hole 42 is shown on the second portion 32 of the mount assembly 20; in various other embodiments, the release button 40 and hole 42 may be located elsewhere. The mount assembly 20*b* may generally include a first portion 30 that is parallel to a barrel rail assembly 13 when coupled to another object and a second portion 32 that is coupled to a plate 14 of the shield 10 system.

Figure 10A:
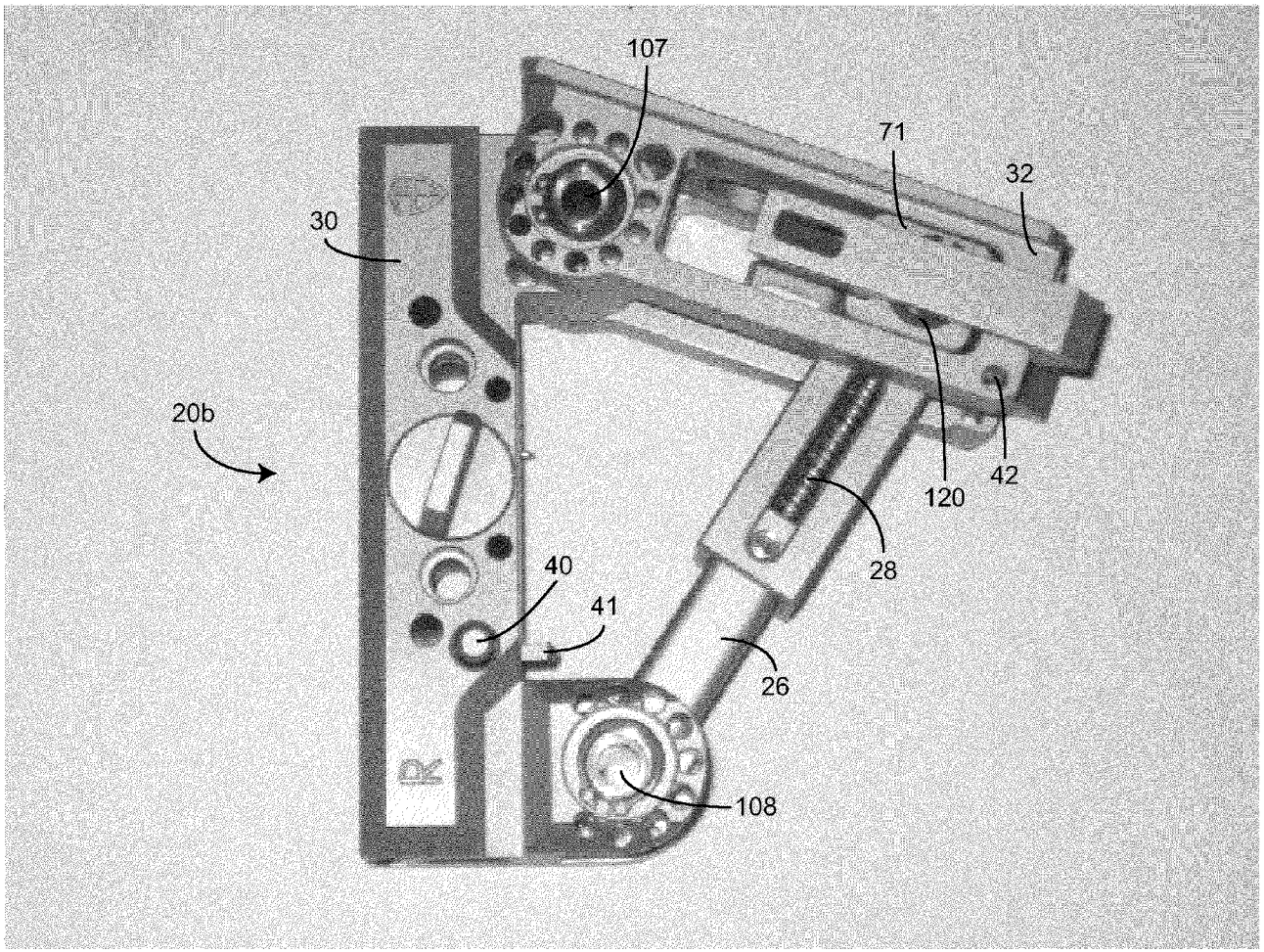
FIG. 10A is a first perspective view image of the mount assembly shown in FIGS. 7-9 in an expanded position, according to another exemplary embodiment.

Referring generally to FIG. 10A, the locking mechanism of mount assembly 20*b* is shown in greater detail. The mount assembly 20*b* is shown as expanded after operation of one or both of the release buttons 40 and the hole 42 (or another action for expanding the mount assembly 20*b*). As shown, release button 40 may include, or may be coupled to, latch 41 configured to engage hole 42 of the second portion 32. Release button 40 may be spring-actuated such that depressing release button 40 disengages latch 41 from hole 42, thereby releasing the second portion 32 from its closed position.

The release button 40 and one or more clips 54 may provide the mount assemblies 20 with quick-open/quick-close capability. For example, the mount assemblies 20 may include a spring ball plunger on the first portion 30 that assists the flexor arm assembly 26 to push the second portion 32 towards the extended position, when the release button is depressed (e.g., the assembly snaps open). In some embodiments, the second portion 32 may be automatically brought to the full extended position, e.g., without further force from the user. In other embodiments, the second portion 32 may arrive at an angle that is less than that of the extended position. In such a case, the user may manually engage the extended position retainer (e.g., one or more clips 54 connected to the flexor arm assembly 26) to the second portion 32, to bring the assembly to the fully extended position. The clip 54 may then lock the assembly in the expanded position.

Figure 10B:
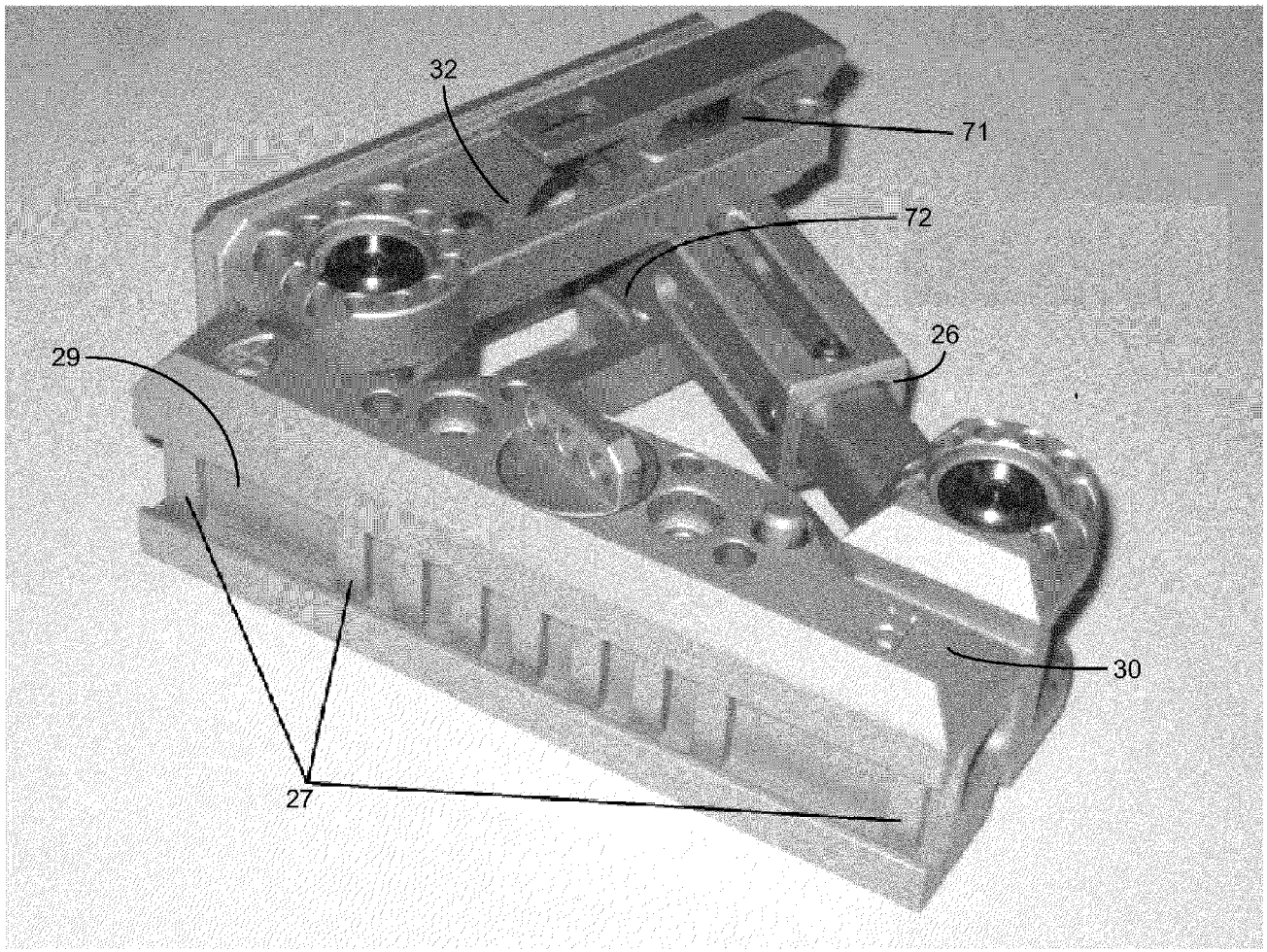
FIG. 10B is a second perspective view image of the mount assembly shown in FIG. 10A in an expanded position, according to another exemplary embodiment.
Figure 11A:
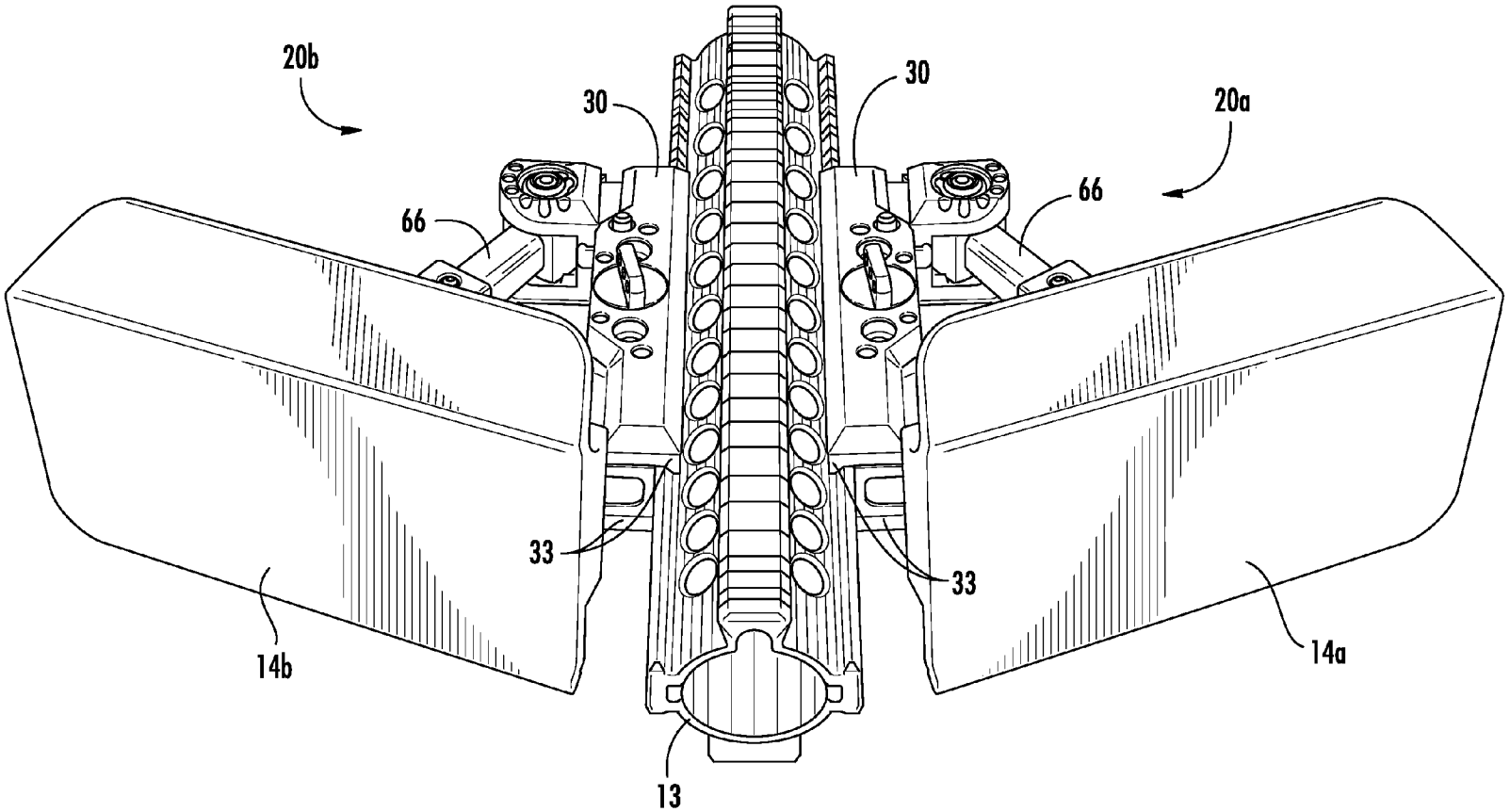
FIG. 11A is a perspective view image of the shield illustrated in FIG. 2 attached to a barrel rail including two mount assemblies in their extended positions, according to another exemplary embodiment.
Figure 11B:
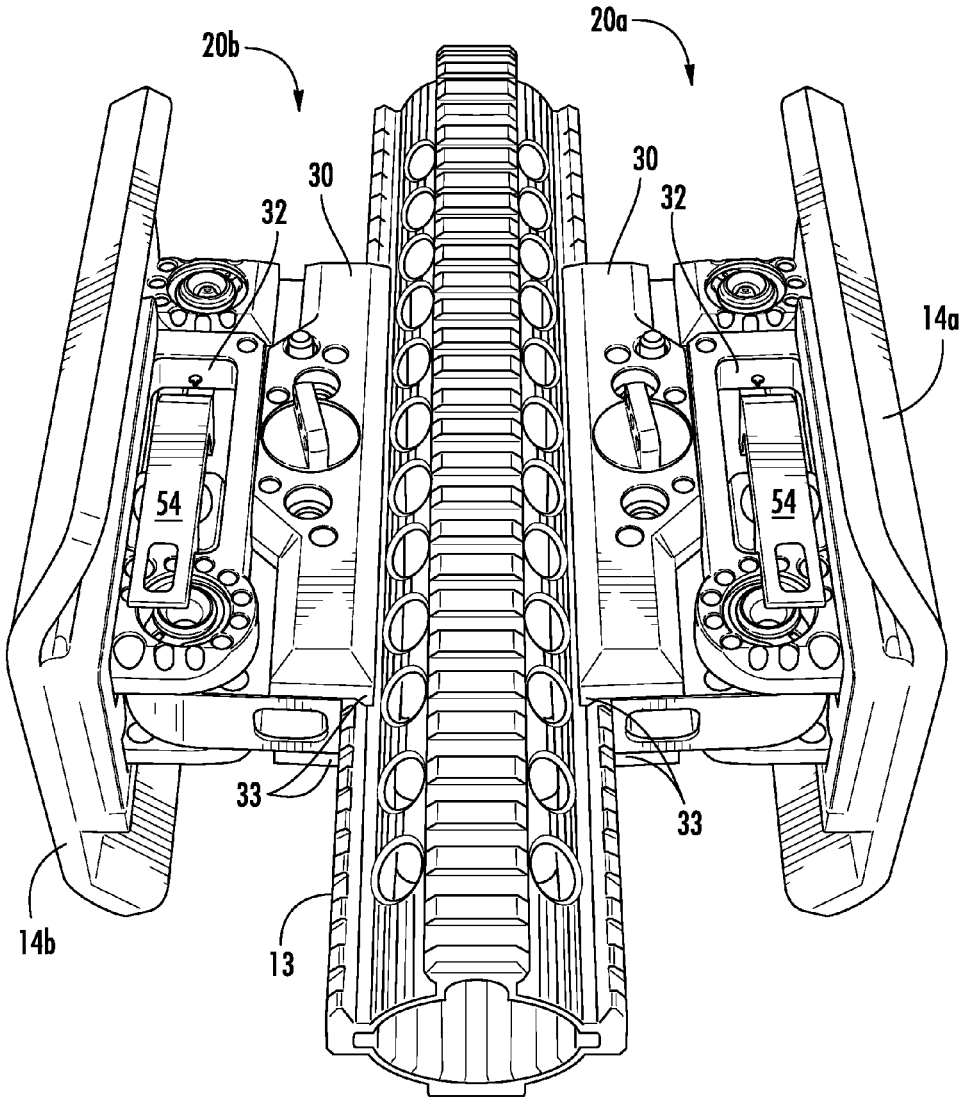
FIG. 11B is a perspective view image of the two mount assemblies of FIG. 11A in their closed positions, according to another exemplary embodiment.

Referring more specifically to FIG. 9 and FIG. 10B, a mount rail 29 is shown on the side of the first portion 30 of the mount assembly 20*b*. The mount rail 29 may be configured to attach to a barrel rail of barrel rail assembly 13. The mount rail 29 is shown with several rail shear blocks 27, according to one embodiment. The rail shear blocks 27 may be configured to fit with the notches and protrusions on the barrel rail of barrel rail assembly 13 such that the mount rail 29 is more securely fastened to the barrel rail and in a way that allows for easy attachment or detachment of the mount assembly 20*b* from the rail. The rail shear blocks 27 on the mount rail 29 may further allow for proper alignment of the mount assembly 20*b* and the shield 10 when in use. Further, the mount rail 29 may be configured to absorb impact from a ballistic impact on the ballistic plate 14*b* attached to mount assembly 20*b*.

Referring further to FIG. 10B, the movement of flexor arm assembly 26 is described in greater detail. As the mount assembly 20*b* moves from a collapsed position to an expanded position by moving an end of the first portion 30 and the second portion 32 apart, the flexor arm assembly 26 extends to secure the position of the two portions 30, 32. In the embodiment shown in the figures, one end of the flexor arm assembly 26 may slide within the second portion 32. The flexor arm assembly 26 may include slide guides 71 that may be configured to slide inside of openings within the second portion 32. An outside clip 54 may be connected to the slide guide 71 with a pin 72 (hidden). Clip 54 (described in subsequent figures) may lock the flexor arm assembly 26 in position when the mount assembly 20*b* is expanded.

Referring generally to FIGS. 11A-17, the extended and closed configurations of the mount assemblies 20 of shield 10 are shown in greater detail. The shield 10 is shown to include two weapon mount assemblies 20, although other numbers of weapon mount assemblies 20 and plates 14 may be used, such as one, three, four, etc. FIGS. 11A, 13, 15, and 16 generally show different perspective views of the shield 10 with both of mount assemblies 20 in their extended positions. FIGS. 11B, 12, 14, and 17 generally show different perspective views of the shield 10 with both of mount assemblies 20 in their closed positions. Greater detail regarding how ballistic plates 14 are mounted to mount assemblies 20 and how flexor arms 26 operate is provided from the views shown in FIGS. 11A-17.

Figure 15:
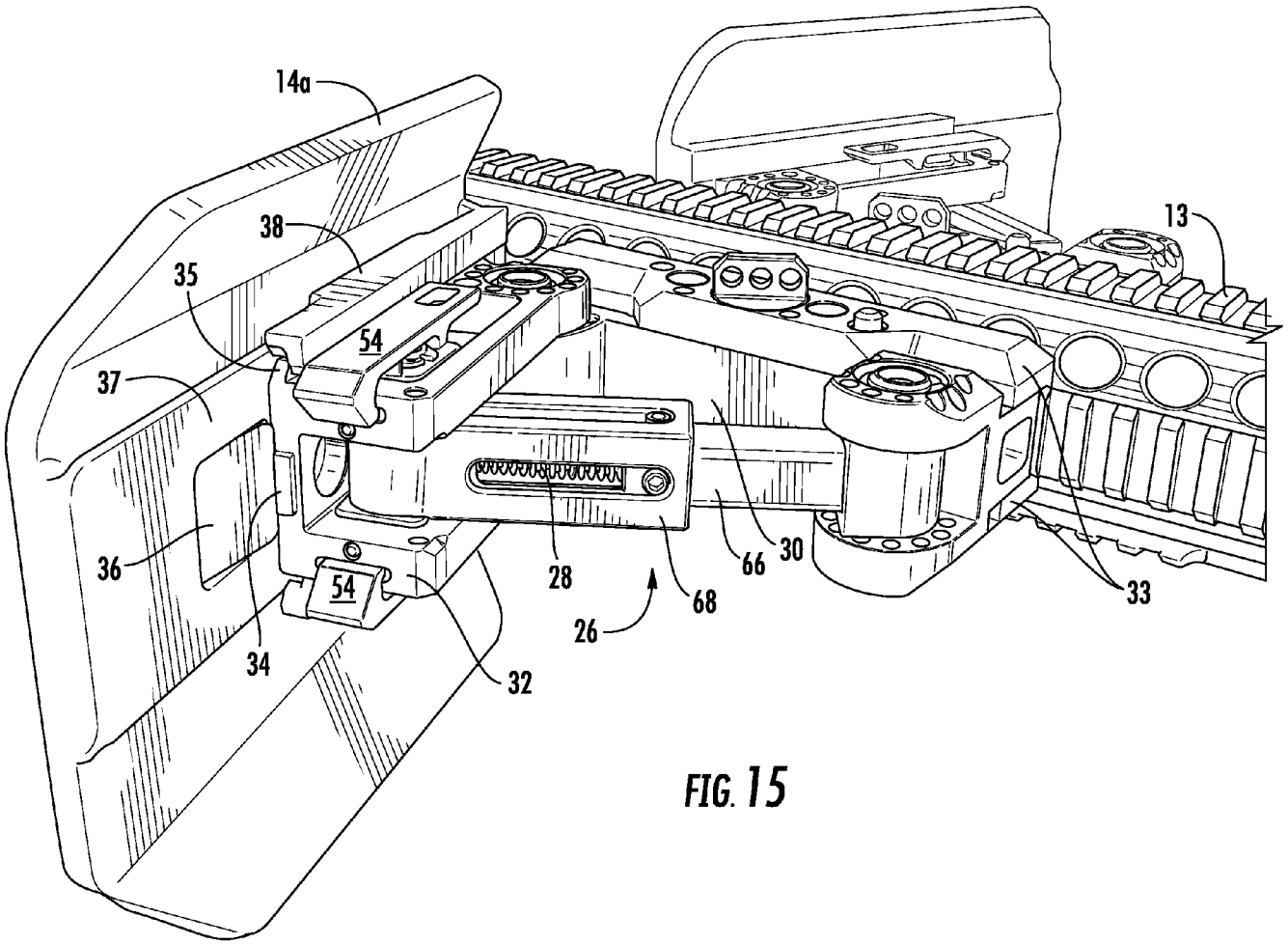
FIG. 15 is a third perspective view image of the two mount assemblies of FIG. 11A and FIG. 13 in their extended positions, according to another exemplary embodiment.
Figure 16:
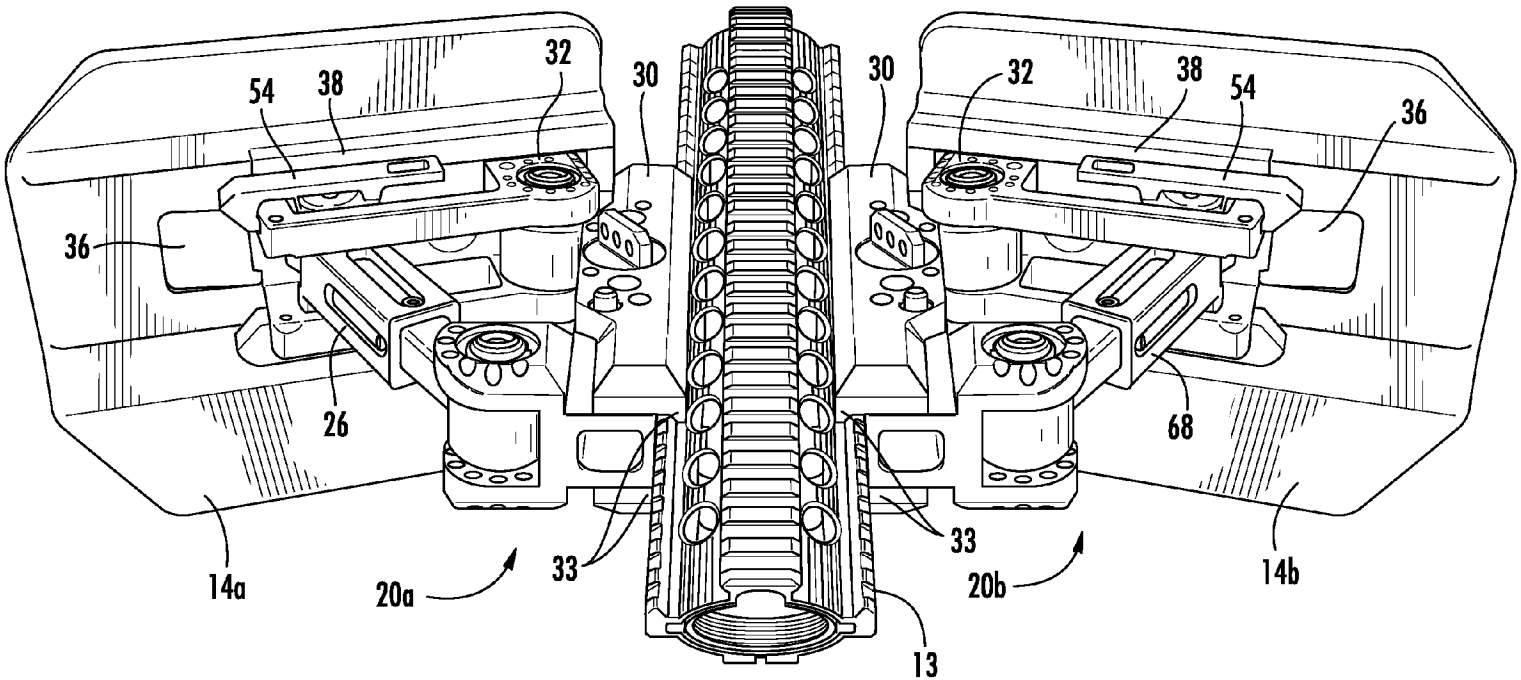
FIG. 16 is a fourth perspective view image of the two mount assemblies of FIGS. 11A, 13, and 15 in their extended positions, according to another exemplary embodiment.
Figure 17:
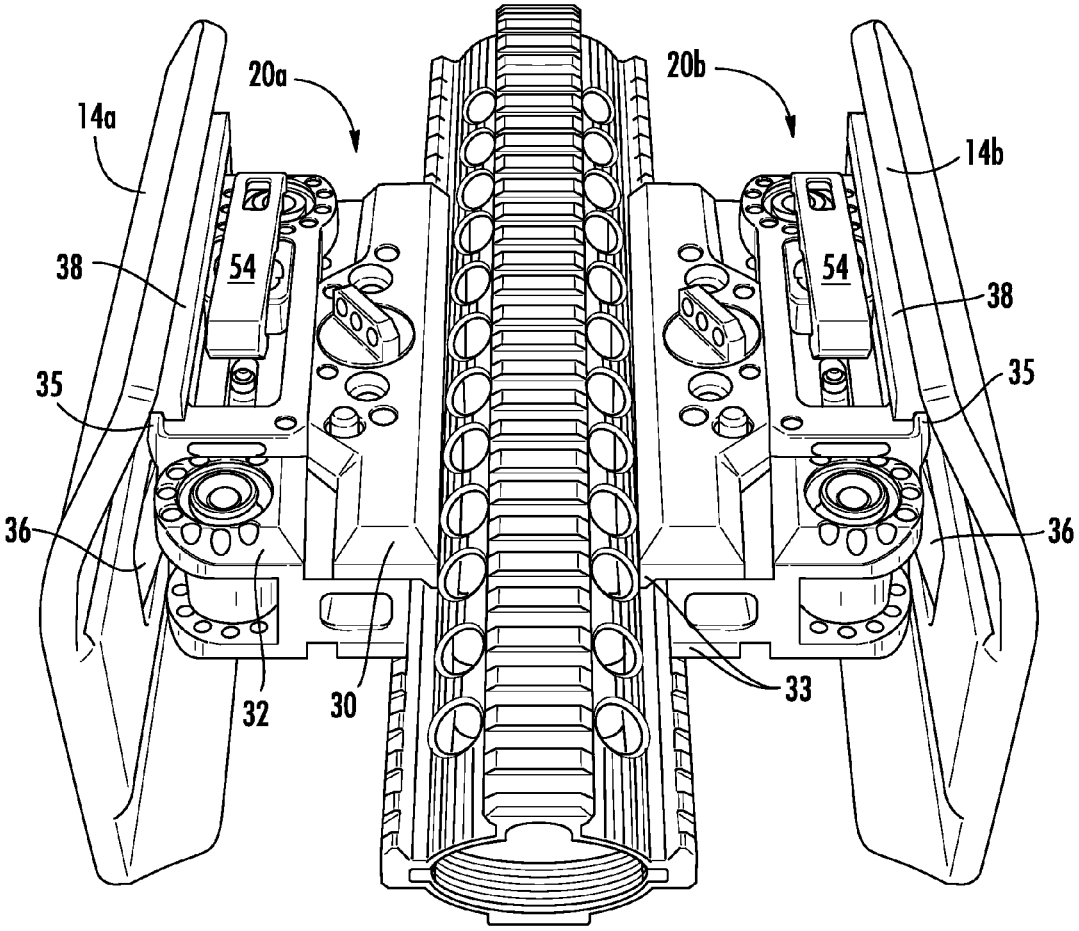
FIG. 17 is a fourth perspective view image of the two mount assemblies of FIGS. 11B, 12, and 14 in their closed positions, according to another exemplary embodiment.

As shown in greater detail in FIG. 15, the second portion 32 includes a panel rail 35, and the ballistic plate 14*a* includes a plate retainer 38. The plate retainer 38 is configured to slidably engage the panel rail 35, allowing a user to slide the ballistic plate 14*a* on or off the shield for assembly or disassembly. When the second portion 32 is in the retracted position, the ballistic plate 14*a* may be slid onto the panel rail 35, creating the configuration as shown in FIGS. 11B, 12, 14, and 17. The second portion 32 may be extended to a specific angle that is less than approximately (e.g., within two degrees, within five degrees, etc.) perpendicular with the first portion 30. For example, the second portion 32 may form an angle of approximately less than 70 degrees with the first portion 30 when the second portion 32 is extended.

The ballistic plate 14*a* may be held in place by a spring loaded locking arm (e.g., armor catch spring 36), according to one embodiment. In another embodiment, the ballistic plate 14*a* may include ridges as part of the plate retainer 38 and held in place by a ratcheting spring loaded locking arm that engages the ridges. The user may slide in the ballistic plate 14*a* onto the panel rails 35 of mount assembly 20*a*, and the armor catch spring 36 automatically locks in the plate 14*a*, according to one embodiment. The user may squeeze, press, or otherwise operate the armor catch spring 36 in order to release the plate 14*a* and slide out the plate 14*a* from second portion 32, according to one embodiment. In some embodiments, the locking mechanism may extend beyond the plate retainer 38.

A ballistic plate 14 may be releasably coupled to a shield mount, according to various embodiments. In some embodiments, the second portion 32 of a mount may include a panel rail 35 for mounting the ballistic plate 14. The ballistic plate 14 may also include a plate retainer 38 that slidably engages the plate rail 35. For example, a ballistic plate 14 may be attached to the mount by sliding the ballistic plate 14 generally towards the buttstock of the firearm and detached from the mount by sliding the ballistic plate 14 generally towards the muzzle of the firearm. In this way, a ballistic plate 14 may be removed from the firearm when not in use and stored as a separate panel or as a plate insert for a body-worn vest. The ballistic plate 14 further includes an armor backer plate 37 and armor catch spring 36. The backer plate 37 supports the armor plate retainer 38 and armor catch spring 36. The second portion 32 includes a catch spring stop block 34 configured to prevent hyperextension of the armor catch spring 36. The backer plate 37 and its components may also be configured to absorb a ballistic impact.

The mount assemblies 20 may include flexor arms 26 coupled to the first portion 30 and second portion 32. The flexor arm assembly 26 extends when the second portion 32 is moved to an extended position and retracts when the second portion 32 is moved towards the first portion 30. According to one embodiment, the flexor arm assembly 26 includes a shock absorber 28. Referring back to FIG. 6, the flexor arm assembly 26 is shown to include a shock absorber 28 in the form of a spring. The spring absorbs energy when the ballistic plate 14 is impacted.

The flexor arm assembly 26 is configured to rotate about an axis substantially perpendicular to the barrel at the coupling of the flexor arm assembly 26 and first portion 30. For example, flexor arm assembly 26 may be connected to first portion 30 via a pivot 108, shown in greater detail in FIG. 10A. The flexor arm assembly 26 is further configured to be substantially parallel to the first portion 30 when the second portion 32 is in the retracted position (shown, for example, in FIG. 17). In some embodiments, the flexor arm assembly 26 may slidably engage the second portion 32 and include an extended position retainer 54 that attaches to the second portion 32. For example, the second portion 32 may include one or more grooves configured to be engaged by the extended position retainer 54. Such grooves are shown in second portion 32 of FIG. 22, according to one embodiment. Similarly, the second portion 32 may include one or more spring plungers (e.g., within one or more of the apertures of second portion 32) to facilitate securement of the extended position retainer 54 to the second member.

The frontal part of a mount assembly 20 serves as the axis of rotation of the plate attachment second portion 32. This allows the second portion 32 to be collapsed when the shield 10 is not in use (as shown in FIGS. 7-9) and also allows the shield 10 to flex outwards about the axis of rotation for deployment.

The aft portion of the weapon mount assembly 20 serves as the axis of rotation for the shock absorption assembly (e.g., including the flexor arm assembly 26). The shock assembly is expandable and collapsible and may be a spring loaded system that has an internal arm (flexor arm 66) and internal spring (shock absorber 28). The flexor arm assembly 26 is connected to the axis of rotation. An external sleeve 68 operates over the internal components (as shown in FIG. 15). The combination of the internal flexor arm 66 and external sleeve 68 provide lateral rigidity to the arm when the shield is expanded. The external sleeve 68 is connected to two guide blocks 71 that slide inside of openings in the second portion 32.

The guide blocks 71 in the second portion 32 run lengthwise along the direction of the track that the ballistic plates are held in place with. This design allows the swing arm to rotate while still being connected to the shock assembly. When the shield 10 is collapsed, the shock assembly is compressed and the guide blocks 71 shift to the end of the swing arm closest to the swing arm's axis of rotation.

As the shield 10 is expanded, the second portion 32 and shock assembly rotate about their respective axes in opposite directions. For example, if the system is installed on the right side of a rail assembly and is being observed from the top point of view, the swing arm would rotate counter-clockwise and the shock assembly would rotate clockwise.

Hence, when completely expanded, the guide blocks 71 will be at the end of the guide openings furthest away from the axis of rotation of the swing arm and the shock assembly (e.g., internal flexor arm 66, external sleeve 68, and shock absorber 28) will be fully extended. During ballistic impact, the shock assembly will compress and the swing arm and ballistic panel will rotate clockwise about the swing arm's axis of rotation. Shortly after the energy transfer has been completed, the ballistic plate will return to the fully expanded position.

The ability of the guide blocks to slide laterally allows the end user to close the system with minimal force. The user can release the locking arm 54 and push the guide blocks towards the axis of rotation for the swing arm. The user can push the impact surface of the ballistic plate 14 inwards; as the guide blocks move closer to the swing arm's axis of rotation, the leverage of pushing on the plate increases and makes collapsing the system easy.

FIG. 15 illustrates the second portion 32 extended from the first portion 30. While extended, the second portion 32 may be rotated about an axis substantially perpendicular to that of the barrel (e.g., via a hinge or similar mechanism). The flexor arm assembly 26 may utilize a similar mechanism and rotate in the opposite direction as that of the second portion 32. For example, the second portion 32 may be rotated in a clockwise direction, which the flexor arm assembly 26 is rotated in a counter clockwise direction, or vice-versa for the opposite mount assembly. The flexor arm assembly 26 may also slide within the second portion 32 and may be held to a side of the second portion 32 while the mount is in the extended position. For example, one or more clips (or locking arm) 54 may be used to maintain the flexor arm assembly 26 in the extended position. In FIG. 15, the flexor arm assembly 26 is shown to generally include the internal flexor arm 66, external sleeve 68, and shock absorber 28.

The mount may also include a barrel rail retainer 33 configured to engage a barrel rail assembly 13, as described previously. The mount assembly 20 may incorporate rail shear blocks 27 to engage the barrel rail assembly 13, as described in FIGS. 9 and 10B. Other forms of mounting mechanisms are also contemplated (e.g., clips, pins, bolts, welding, etc.) to affix a shield mount to the barrel rail. In some embodiments, the barrel rail assembly 13 and one or more shield mounts may be formed as a single assembly.

Figure 18B:
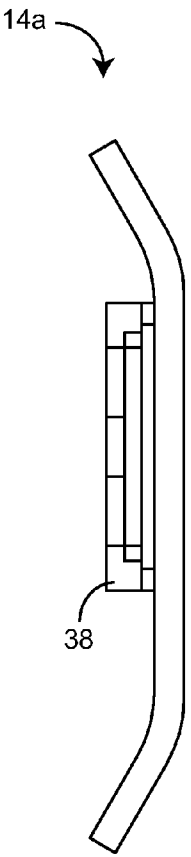
FIG. 18B is a side view of the plate illustrated in FIG. 18A having an armor plate retainer, according to an exemplary embodiment.
Figure 18A:
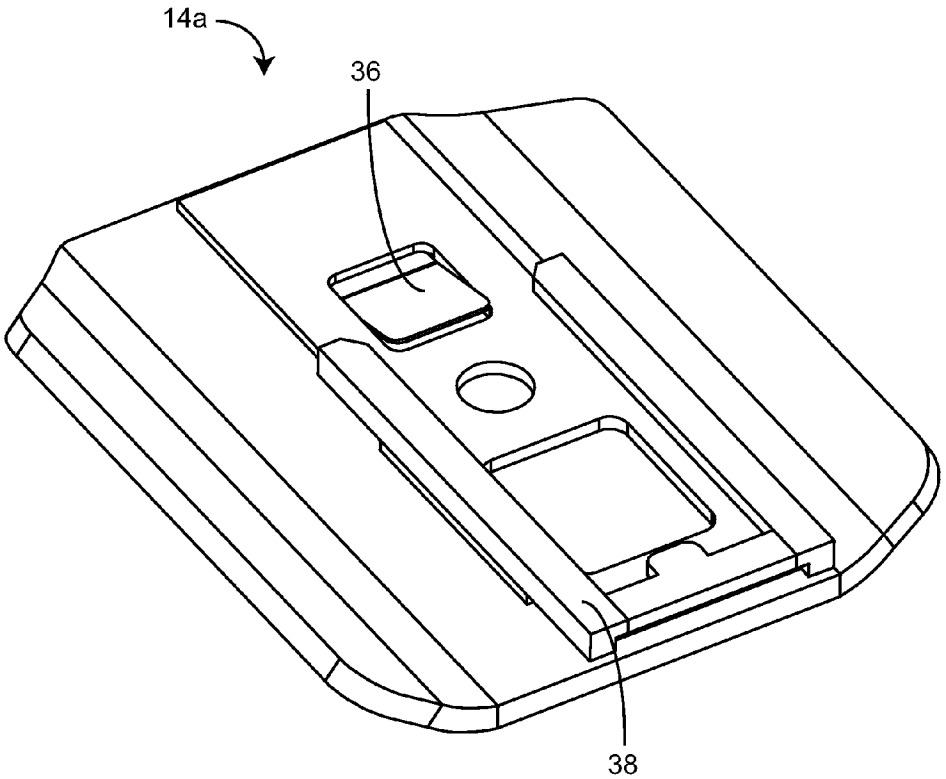
FIG. 18A is a perspective view drawing of a left plate of the shield illustrated in FIG. 2, according to another exemplary embodiment.
Figure 18D:
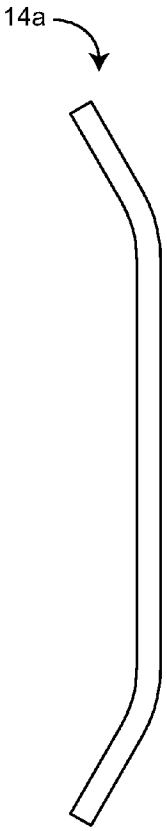
FIG. 18D is a side view of the plate illustrated in FIG. 18A without an armor plate retainer, according to an exemplary embodiment.
Figure 18C:
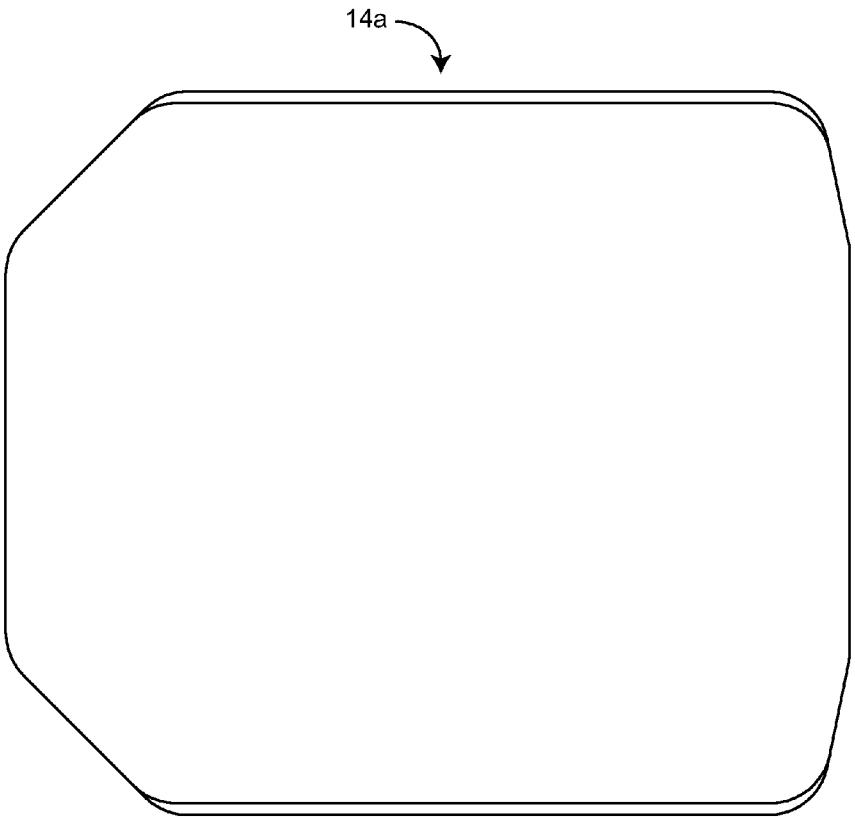
FIG. 18C is a back view of the plate illustrated in FIG. 18A without an armor plate retainer, according to an exemplary embodiment.
Figure 18E:
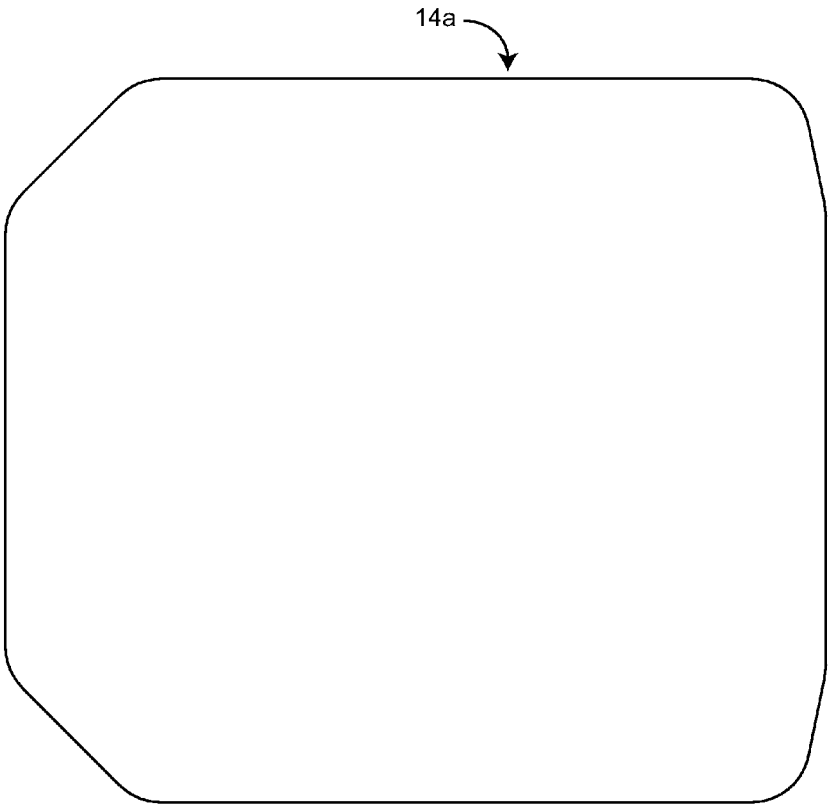
FIG. 18E is a front view of the plate illustrated in FIG. 18C, according to another exemplary embodiment.

FIGS. 18A-18E are schematic diagrams of plate 14*a* of the shield system as described in the present disclosure. Plate 14*a* includes plate retainer 38 configured to retain panel rails 35 which are locked into position by catch spring 36, as shown in greater detail in FIG. 17. In various embodiments, plate 14*a* and plate retainer 38 may be forged as a single body. In other embodiments, plate 14*a* may be forged as a separate body from plate retainer 38, as shown in FIG. 18D. In such cases, plate retainer 38 may be affixed to plate 14*a* via welding, adhesion, bolts, or the like. For example, an existing ballistic plate, such as the plate shown in FIG. 18D, may be upgraded for use with shield 10 by affixing plate retainer 38 onto the plate. Plate 14*a* may also include varying amounts of contouring, as shown in FIGS. 18C and 18E. For example, plate 14*a* may have a substantially flat structure, or plate 14*a* may have contouring along its ends, as shown in FIG. 18D, according to various embodiments.

Figure 19:
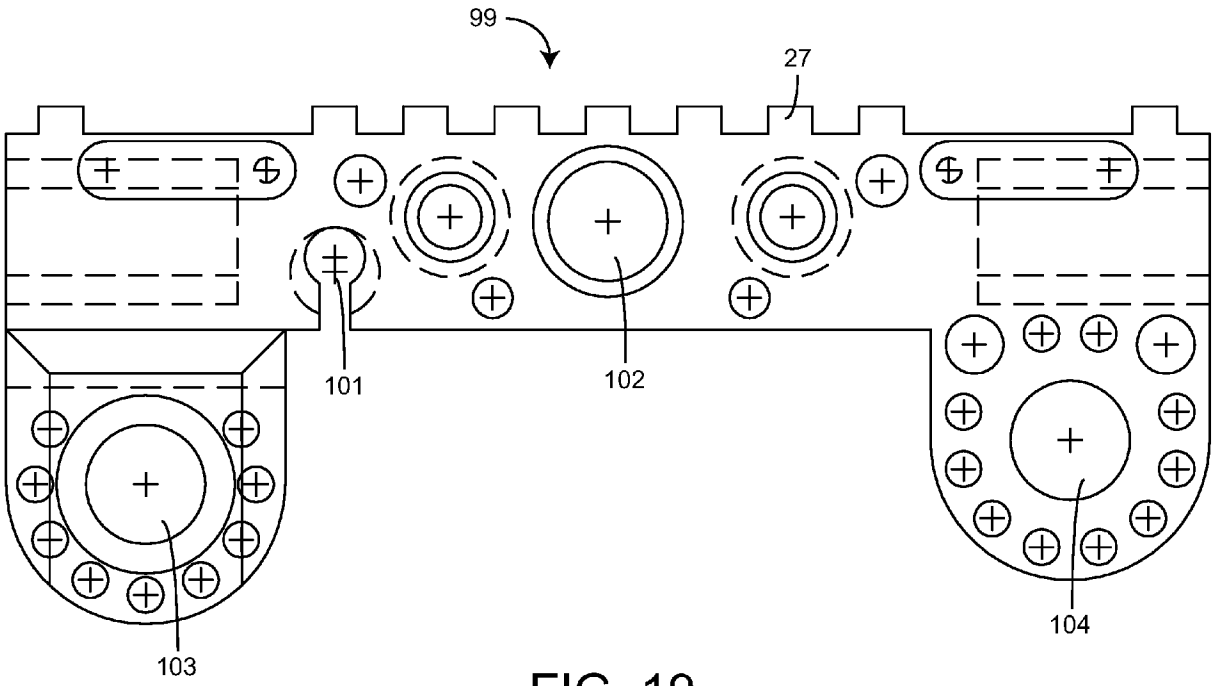
FIG. 19 is a top schematic diagram of a primary body of the mounting assembly shown in FIGS. 10A-10B, according to an exemplary embodiment.

FIG. 19 is a top schematic diagram of the primary body 99 of mounting assembly 20*b* shown in FIGS. 10A-10B, according to an exemplary embodiment. As shown, primary body 99 may include one or more shear blocks 27 configured to engage a rail of a barrel rail assembly. Primary body 99 may also include an aperture 101 configured to receive release button 40 and latch 41. Primary body 99 may further include an aperture 103 configured to receive a pivot 108 connected to flexor arm assembly 26 and an aperture 104 configured to receive a pivot 107 coupled to the second portion 32. Pivots 107, 108 may be pins or other assemblies configured to pivot about an axis, according to various embodiments.

Figure 20:
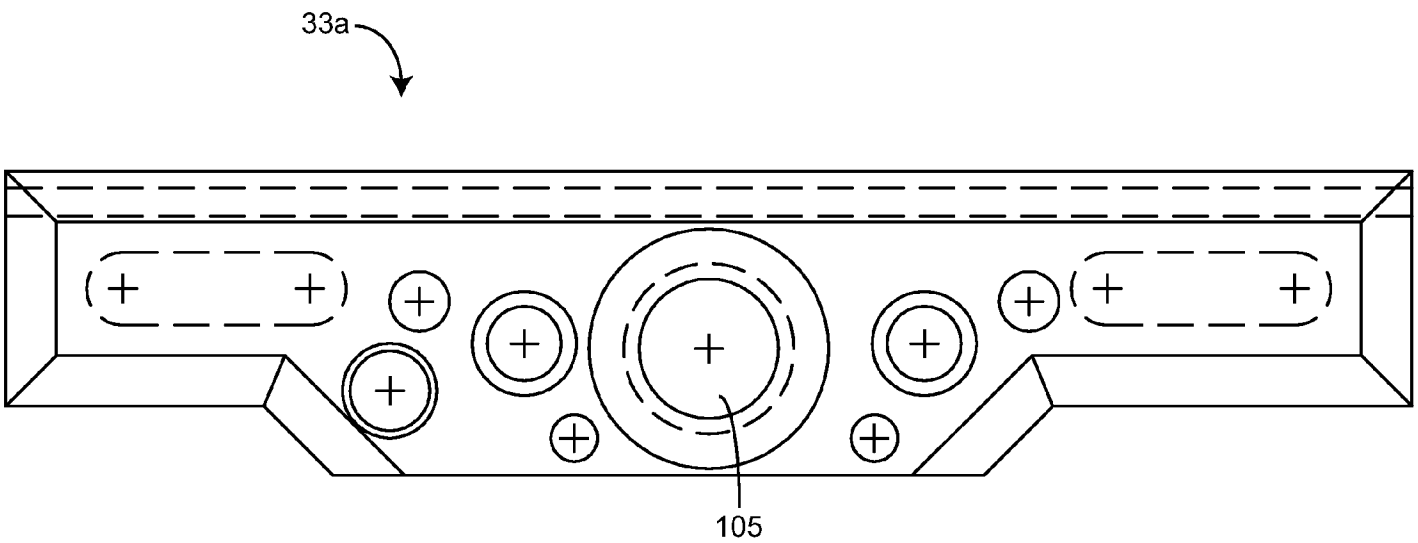
FIG. 20 is a schematic diagram of a top barrel rail retainer, according to an exemplary embodiment.
Figure 21A:
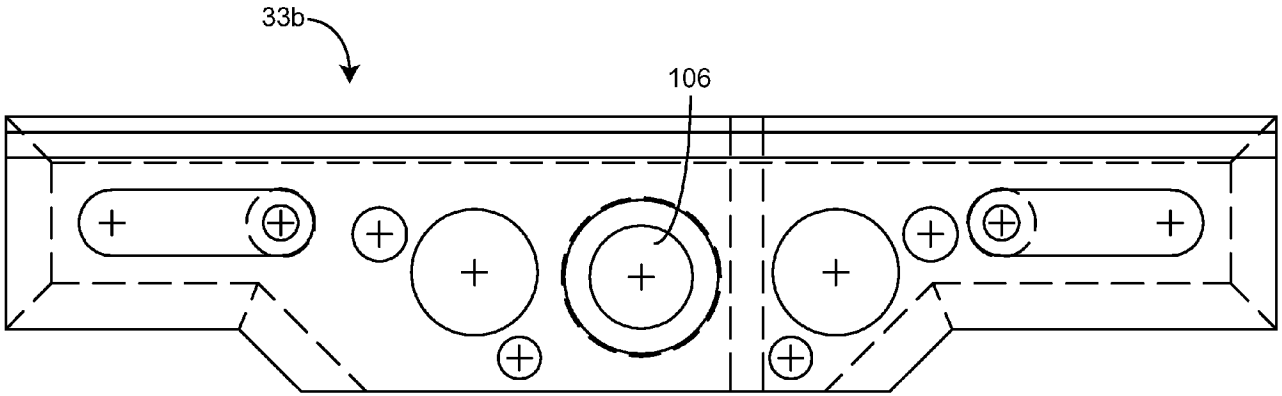
FIGS. 21A-21B are schematic diagrams of a bottom barrel rail retainer, according to an exemplary embodiment.
Figure 21B:
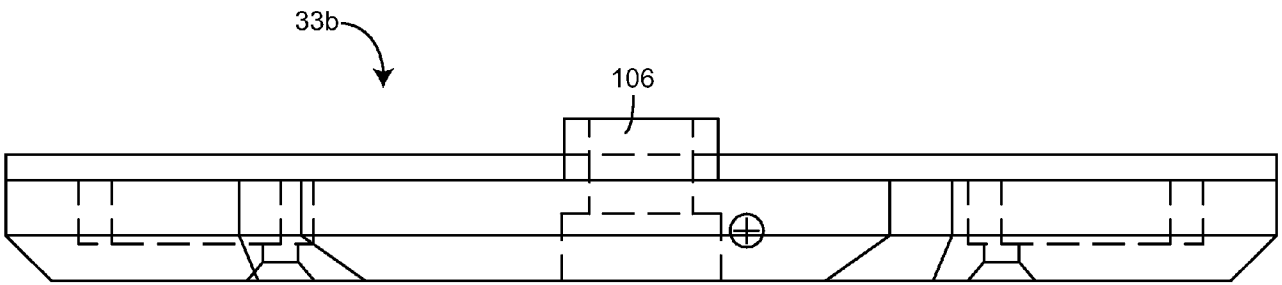

FIGS. 20 and 21A-21B are schematic diagrams of the top and bottom barrel rail retainers 33 of a mount assembly, according to exemplary embodiments. The primary body 99 shown in FIG. 19 may be located between the barrel rail retainers 33, thereby forming a mount assembly 20, according to one embodiment. As shown in FIG. 20, a top barrel rail retainer 33*a* is configured to engage the top of a weapon mounting rail of a barrel rail assembly. Similarly, FIG. 21A shows a top schematic diagram of bottom barrel rail retainer 33*b* and FIG. 21B shows a side schematic diagram of bottom barrel rail retainer 33*b*. Barrel rail retainers 33*a*, 33*b* include apertures 105, 106, configured to receive thumb screw 74 respectively. When thumb screw 74 is installed through apertures 105, 106 of barrel rail retainers 33 and through aperture 102 of primary body 99, compressive force may be applied by barrel rail retainers 33 to a barrel rail when thumb screw 74 is tightened.

Figure 22:
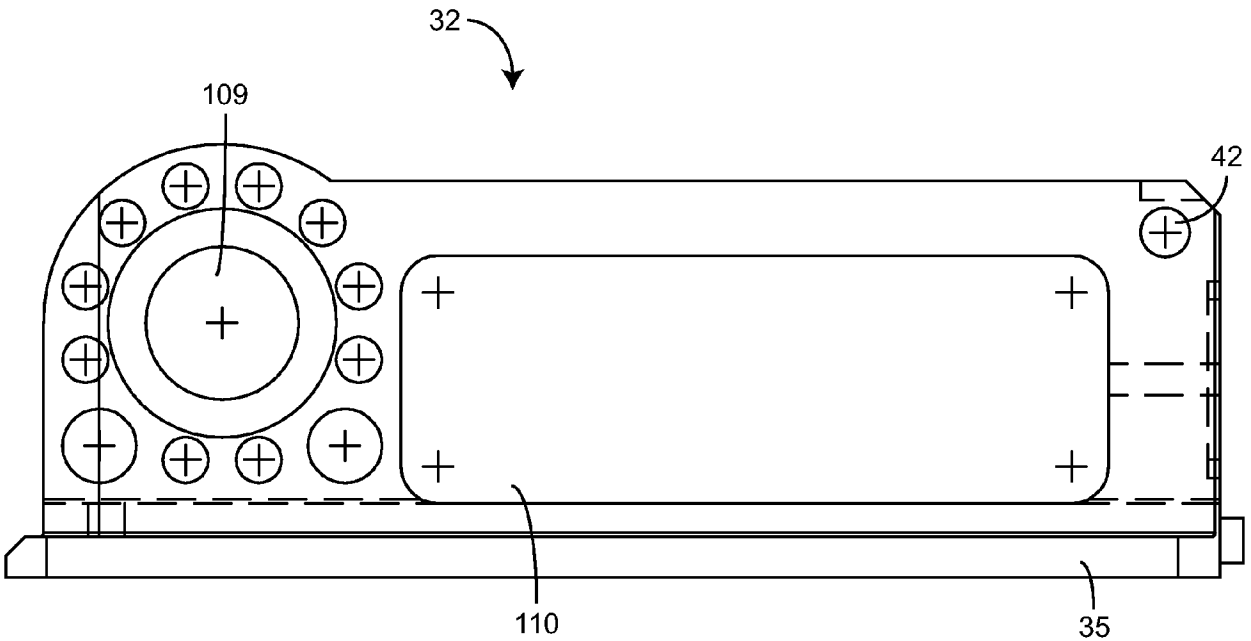
FIG. 22 is a top schematic diagram of a second portion of a mount assembly, according to an exemplary embodiment.

FIG. 22 is a top schematic diagram of a second portion 32 of a mount assembly 20, according to an exemplary embodiment. As shown, second portion 32 may include a panel rail 35 configured to engage a plate retainer 38 of a ballistic plate 14. Second portion 32 may also include a channel 110 through which slide guide 71 may slide (e.g., when the mount assembly 20 transitions between a closed position and an extended position). Second portion 32 may include an aperture 109 which aligns with aperture 104 of primary body 99 of the first portion 30 to receive pivot 107. Second portion 32 may further include hole 42 with which latch 41 may engage to hold second portion 32 together with first portion 30 while the mount assembly 20 is in the closed position.

Figure 23:
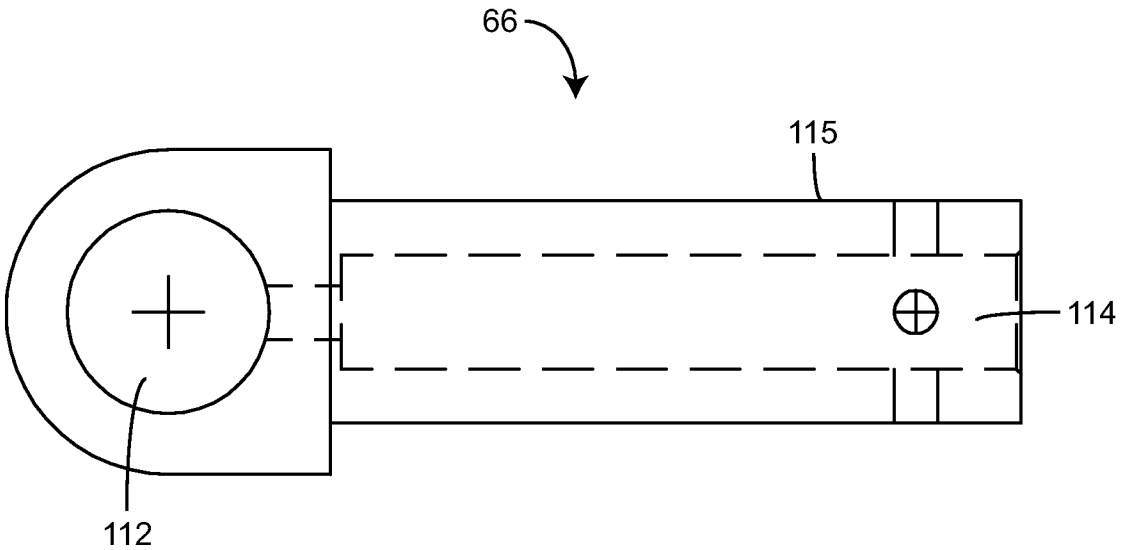
FIG. 23 is a top schematic diagram of an internal flexor arm of a mount assembly, according to an exemplary embodiment.
Figure 24A:
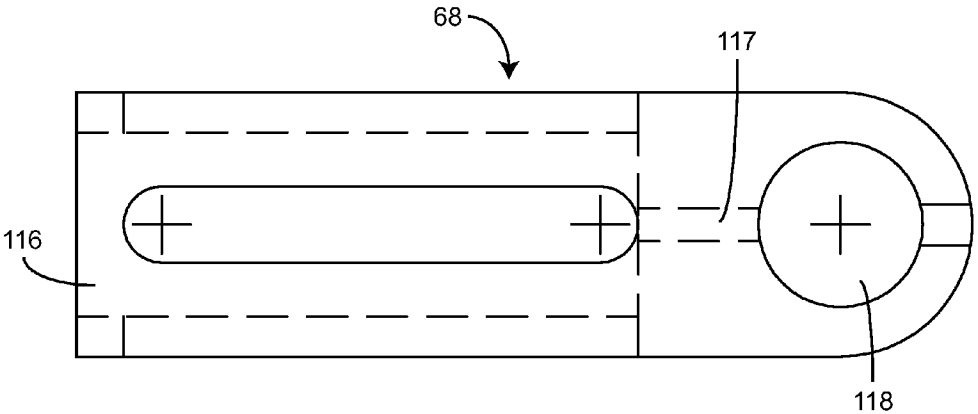
FIG. 24A is a top schematic diagram of an external flexor arm of a mount assembly, according to an exemplary embodiment.
Figure 24B:
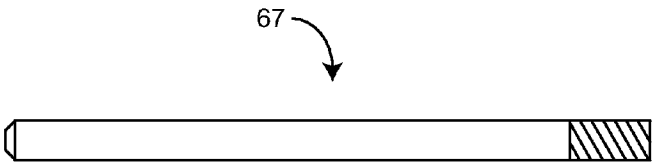
FIG. 24B is a schematic diagram of a spring guide rod used in a flexor arm assembly, according to an exemplary embodiment.

FIGS. 23 and 24A-24B depict components of the flexor arm assembly 26, shown in greater detail in FIG. 15. FIG. 23 is a top schematic diagram of the internal flexor arm 66 of flexor arm assembly 26. FIG. 24A is a top schematic diagram of the external flexor arm 68 of the flexor arm assembly 26 and FIG. 24B is a schematic diagram of a spring guide rod 67 used in the flexor arm assembly 26. External flexor arm 68 includes an aperture 116 configured to receive portion 115 of internal flexor arm 66. External flexor arm 68 also includes an aperture 117 in which spring guide rod 67 may be affixed. For example, spring guide rod 67 may be adhered, welded, or screwed into aperture 117. A spring (not shown) may be positioned around spring guide rod 67 such that the spring extends into aperture 114 of internal flexor arm 66. Thus, internal and external flexor arms 66, 68 may receive opposing forces from the spring. This force may offset the force that results from a ballistic impact. The force may also help to actuate the flexor arm assembly 26 from the closed position (e.g., the position in which portion 115 of internal flexor arm 66 is fully inserted into aperture 116 of external flexor arm 68) to the extended position. Internal flexor arm 66 includes a first aperture 112 configured to align with aperture 103 of primary body 99 and configured to receive pivot 108. Similarly, external flexor arm 68 includes an aperture 118 configured to receive pivot 120 of slide guide 71, thereby allowing slide guide 71 to slide within channel 110 of the second portion 32.

Figure 25:
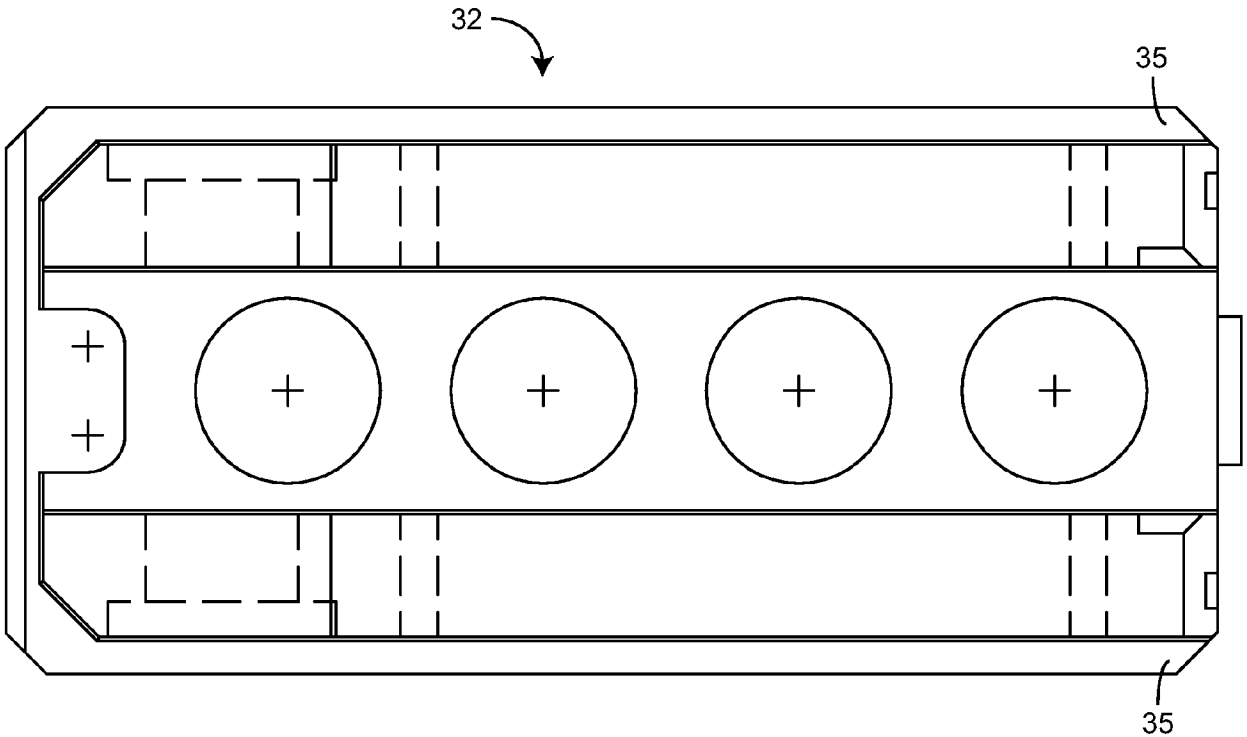
FIG. 25 is a side schematic diagram of the second portion of the mount assembly shown in FIG. 22, according to an exemplary embodiment.
Figure 26A:
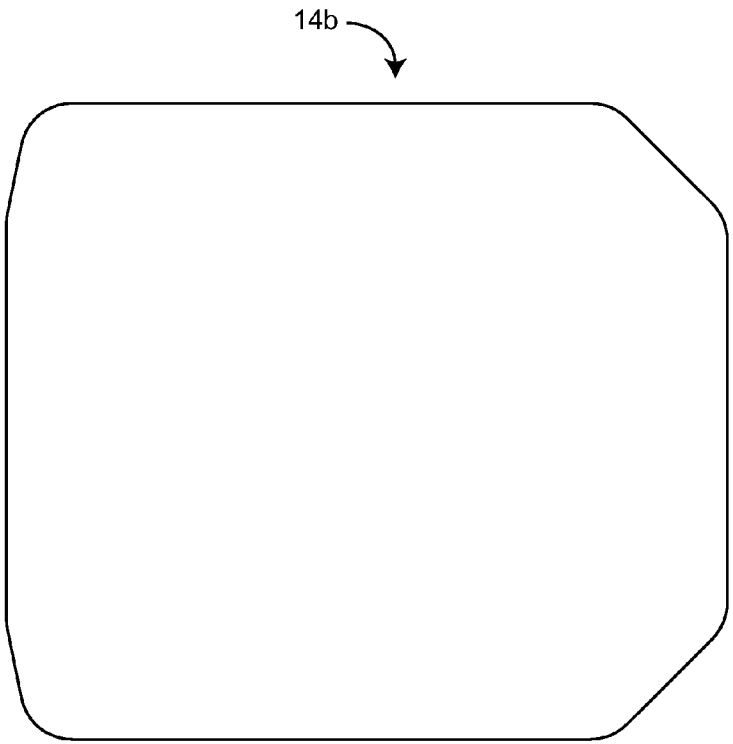
FIG. 26A is a front view drawing of a right side plate of the shield illustrated in FIG. 2, according to another exemplary embodiment.
Figure 26C:
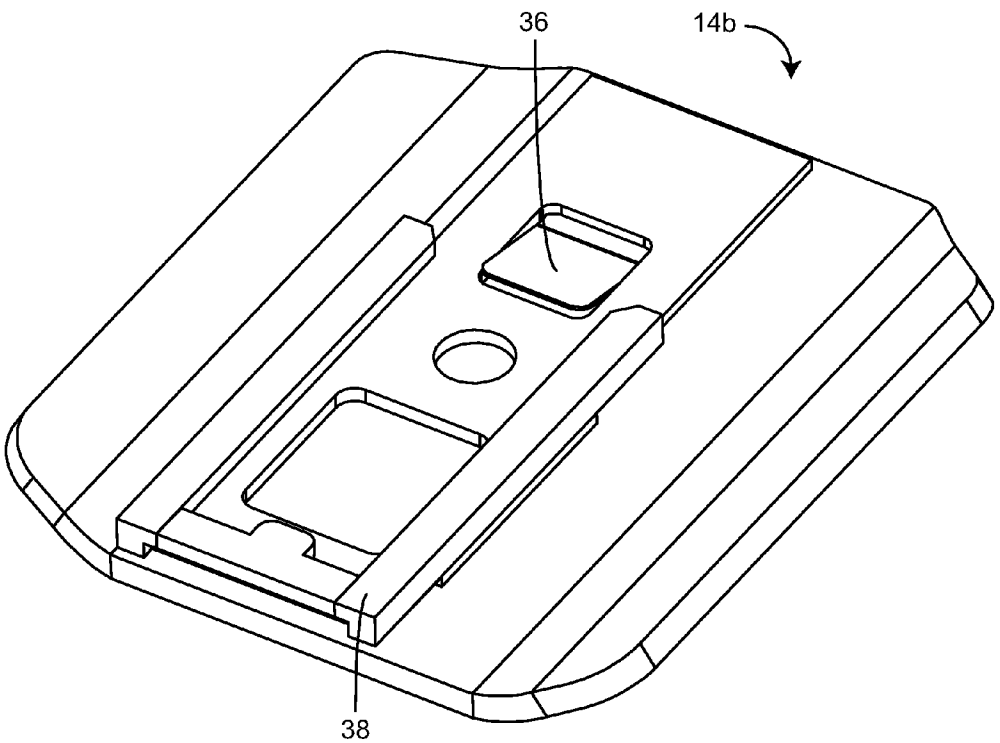
FIG. 26C is a perspective view of the plate illustrated in FIG. 26A, according to an exemplary embodiment.
Figure 26B:
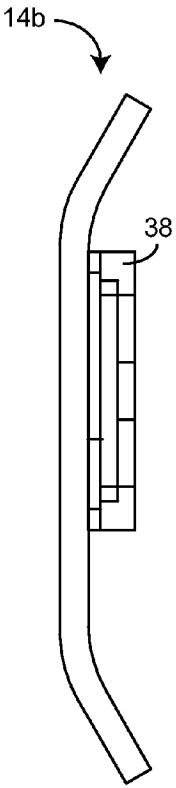
FIG. 26B is a side view of the plate illustrated in FIG. 26A having an armor plate retainer, according to an exemplary embodiment.
Figure 26E:
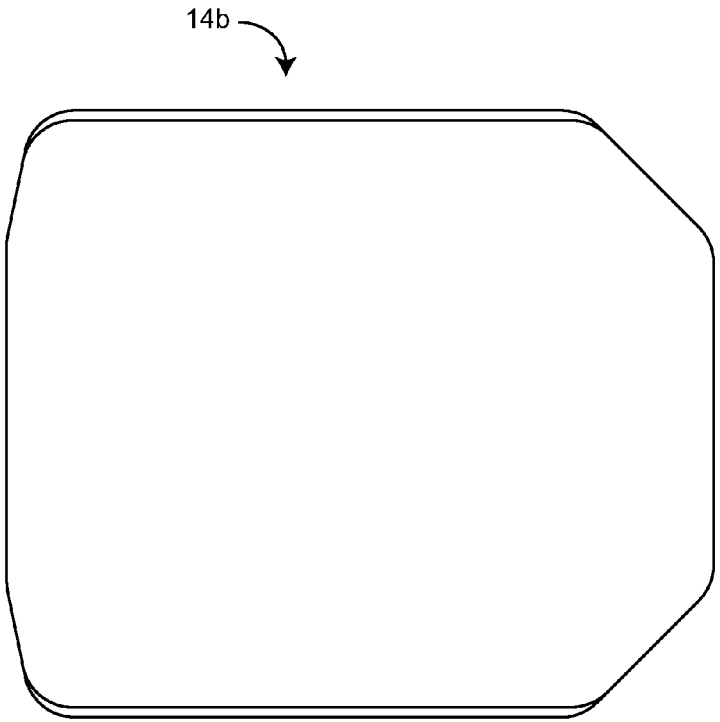
FIG. 26E is a back view of the plate illustrated in FIG. 26C without an armor plate retainer, according to another exemplary embodiment.
Figure 26D:
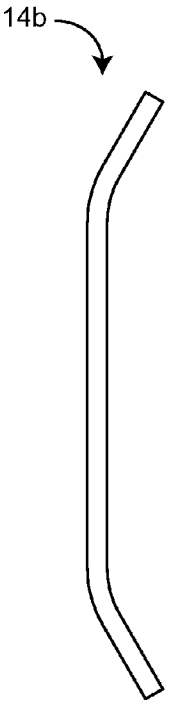
FIG. 26D is a side view of the plate illustrated in FIG. 26A without an armor plate retainer, according to an exemplary embodiment.

FIG. 25 is a side schematic diagram of the second portion 32 shown in FIG. 22. As shown, second portion 32 includes panel rails 35 configured to engage plate retainer 38 of ballistic plate 14. In other words, plate retainer 38 may slide over panel rails 35, thereby connecting the ballistic plate 14 to the second portion 32.

Figure 12:
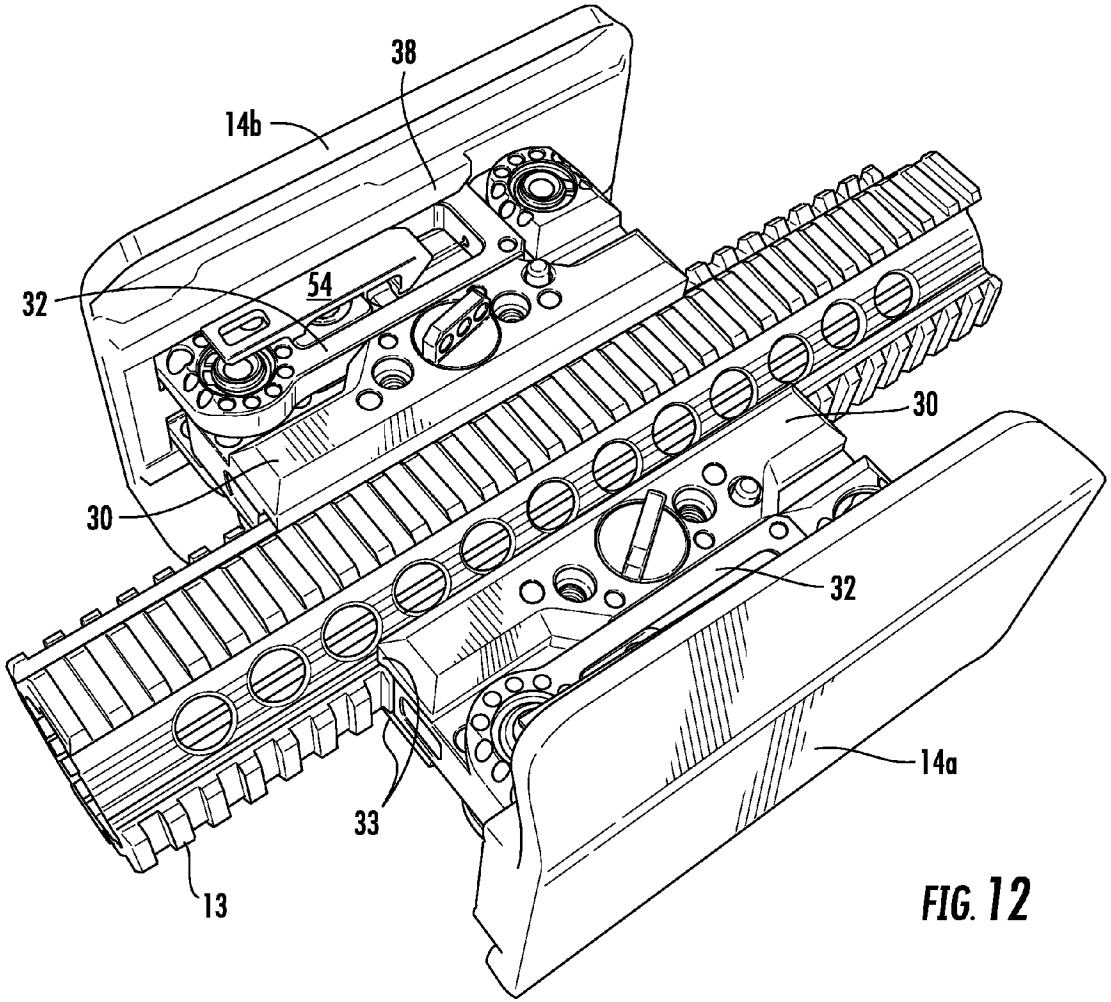
FIG. 12 is a second perspective view image of the two mount assemblies of FIG. 11B in their closed positions, according to another exemplary embodiment.
Figure 13:
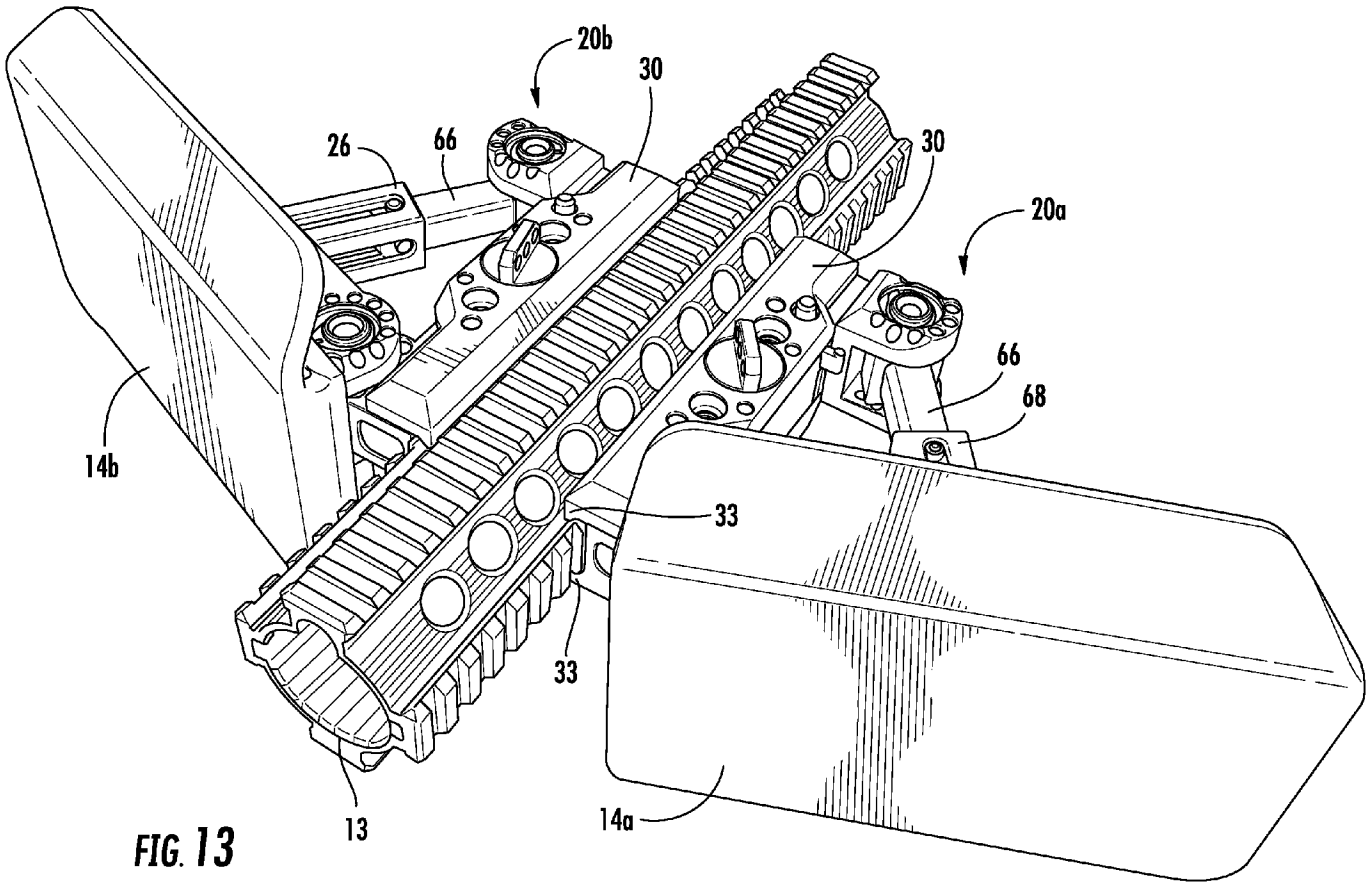
FIG. 13 is a second perspective view image of the two mount assemblies of FIG. 11A in their extended positions, according to another exemplary embodiment.
Figure 14:
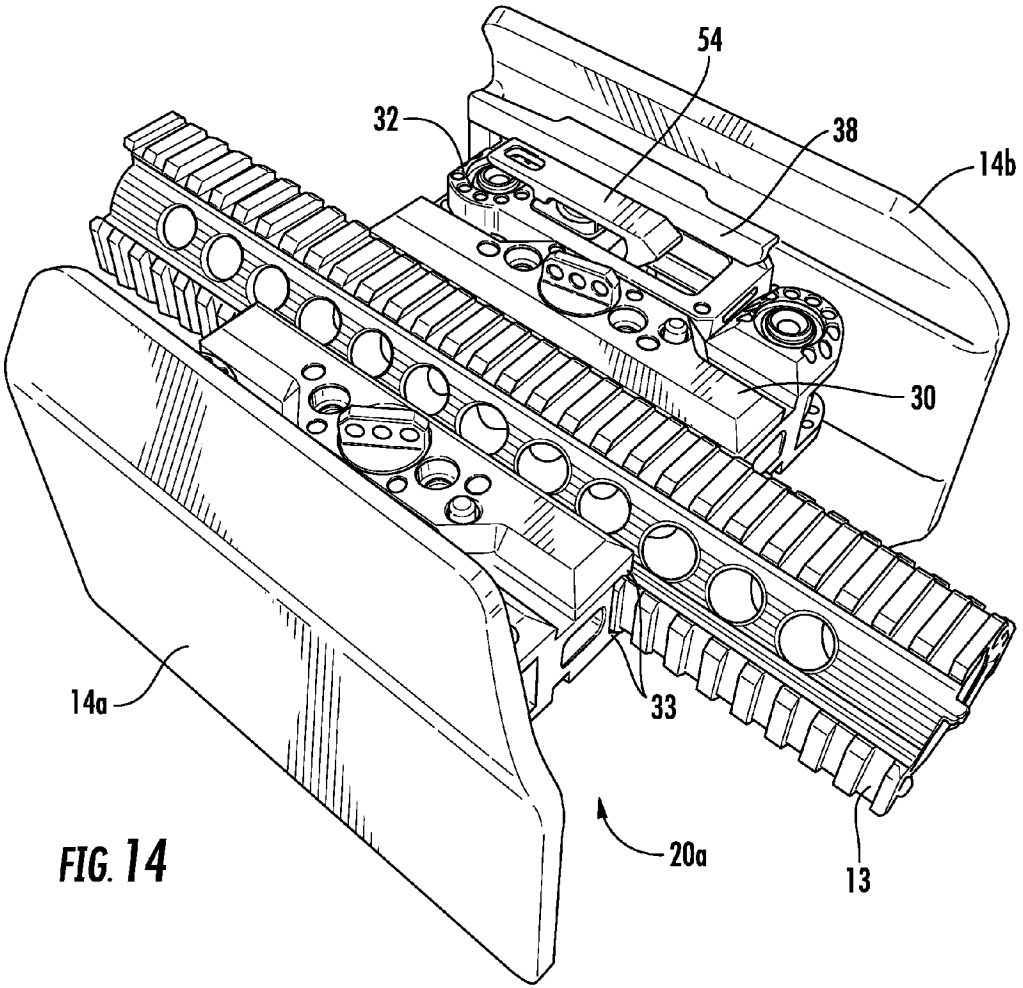
FIG. 14 is a third perspective view image of the two mount assemblies of FIG. 11B and FIG. 12 in their closed positions, according to another exemplary embodiment.

FIG. 26A-26E are schematic diagrams of ballistic plate 14*b*, shown, for example, in FIG. 12. As shown, ballistic plate 14*b* may be the mirror image of ballistic plate 14*a* shown in FIGS. 18A-18E. In some embodiments, ballistic plates 14*a* and 14*b* may have symmetric shapes and contouring. In such a case, ballistic plates 14*a* and 14*b* may be interchangeable. In other embodiments, the shape and contouring of ballistic plates 14*a* and 14*b* may not be symmetric. For example, one side of plate 14*a* may be more contoured than another (e.g., to cause a projectile to deflect at a greater angle upward than downward). In such a case, ballistic plates 14*a* and 14*b* may limited for use on only one side of the barrel rail assembly 13. For example, the contouring of panel 14*a* may be such that it is configured only for use to protect the left side of the user 11, while panel 14*b* may be contoured such that it is configured only for use to protect the right side of the user 11.

Figure 27:
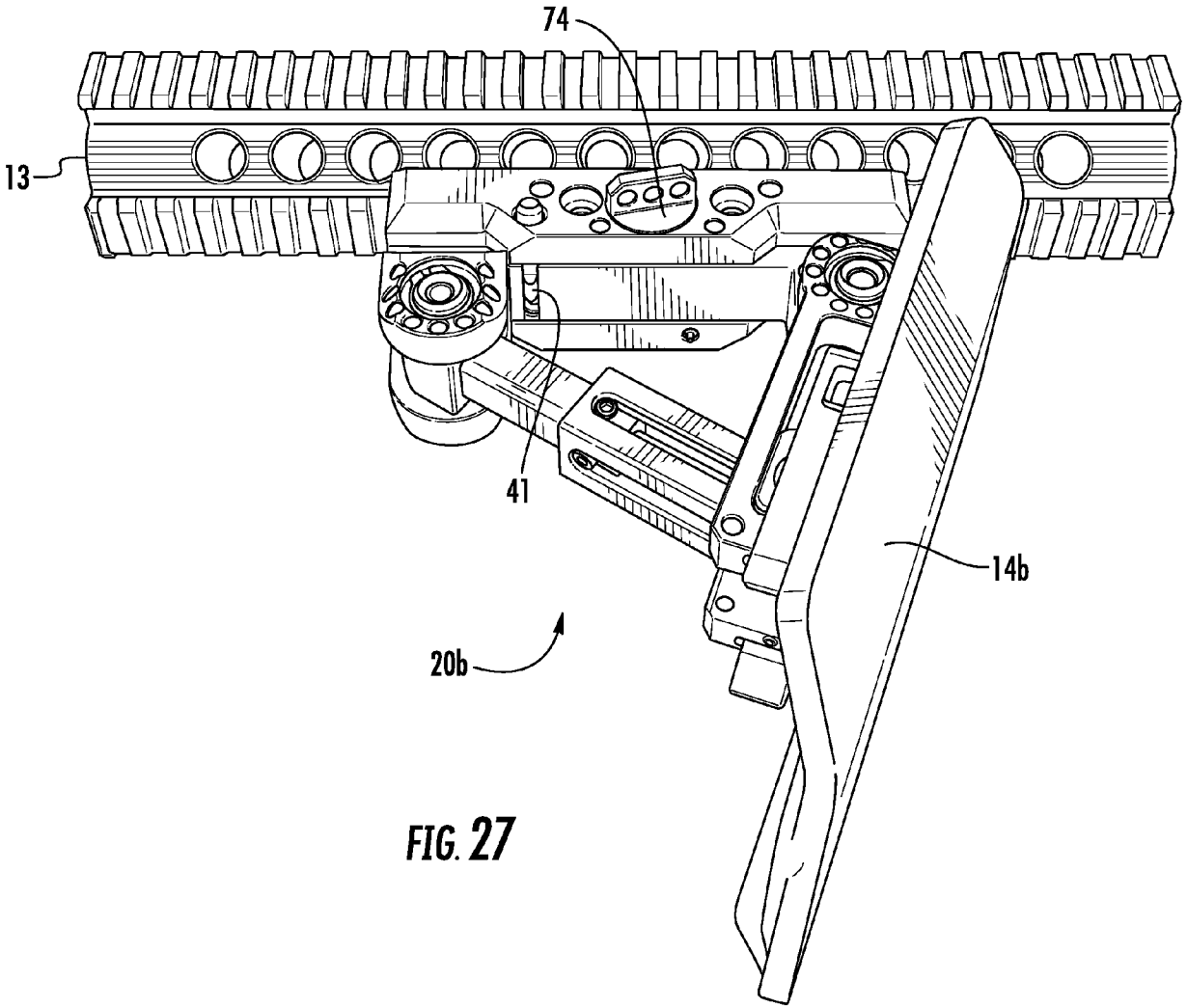
FIGS. 27-32B are images illustrating an expanded mount assembly, according to an exemplary embodiment.
Figure 28:
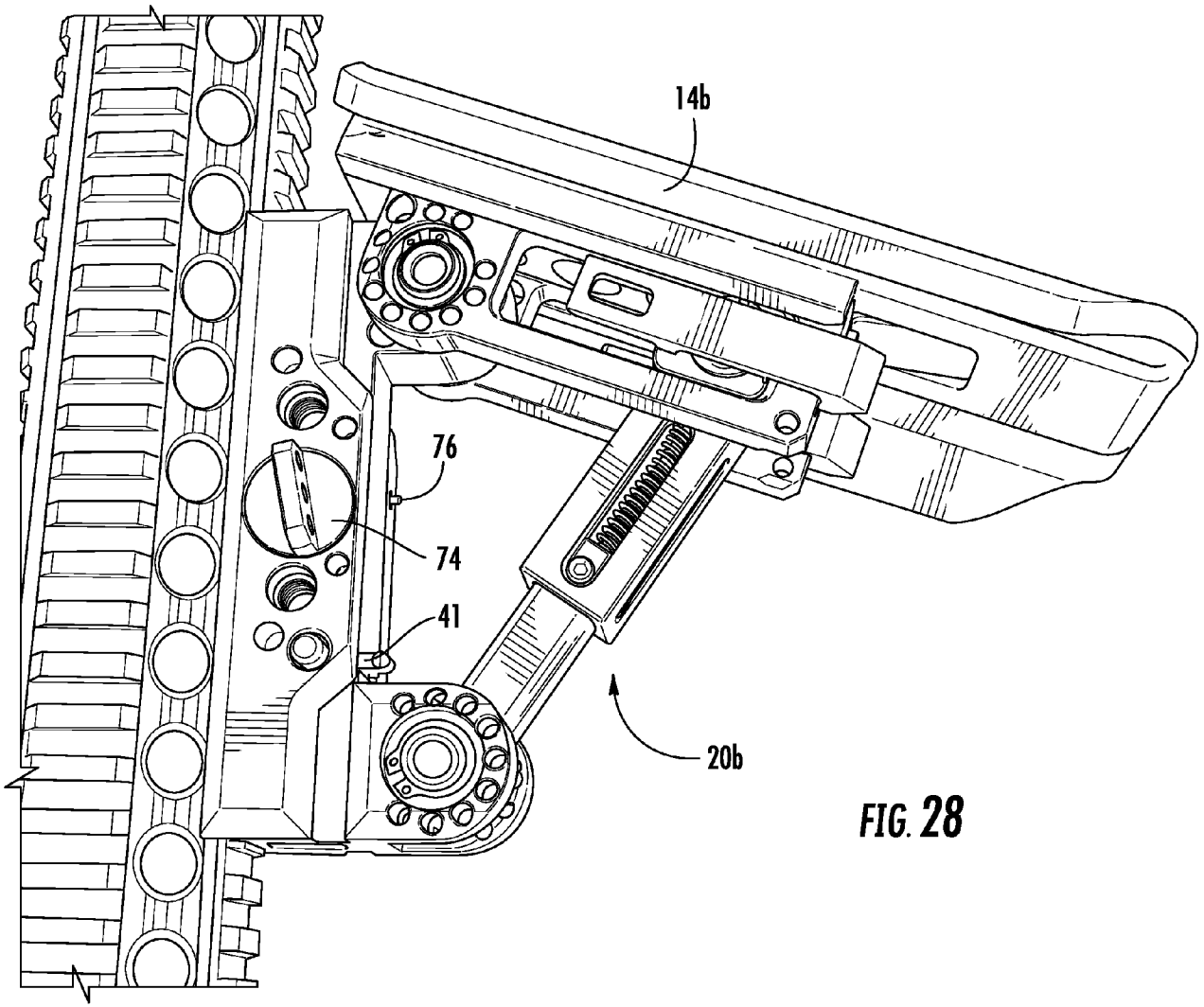
Figure 29:
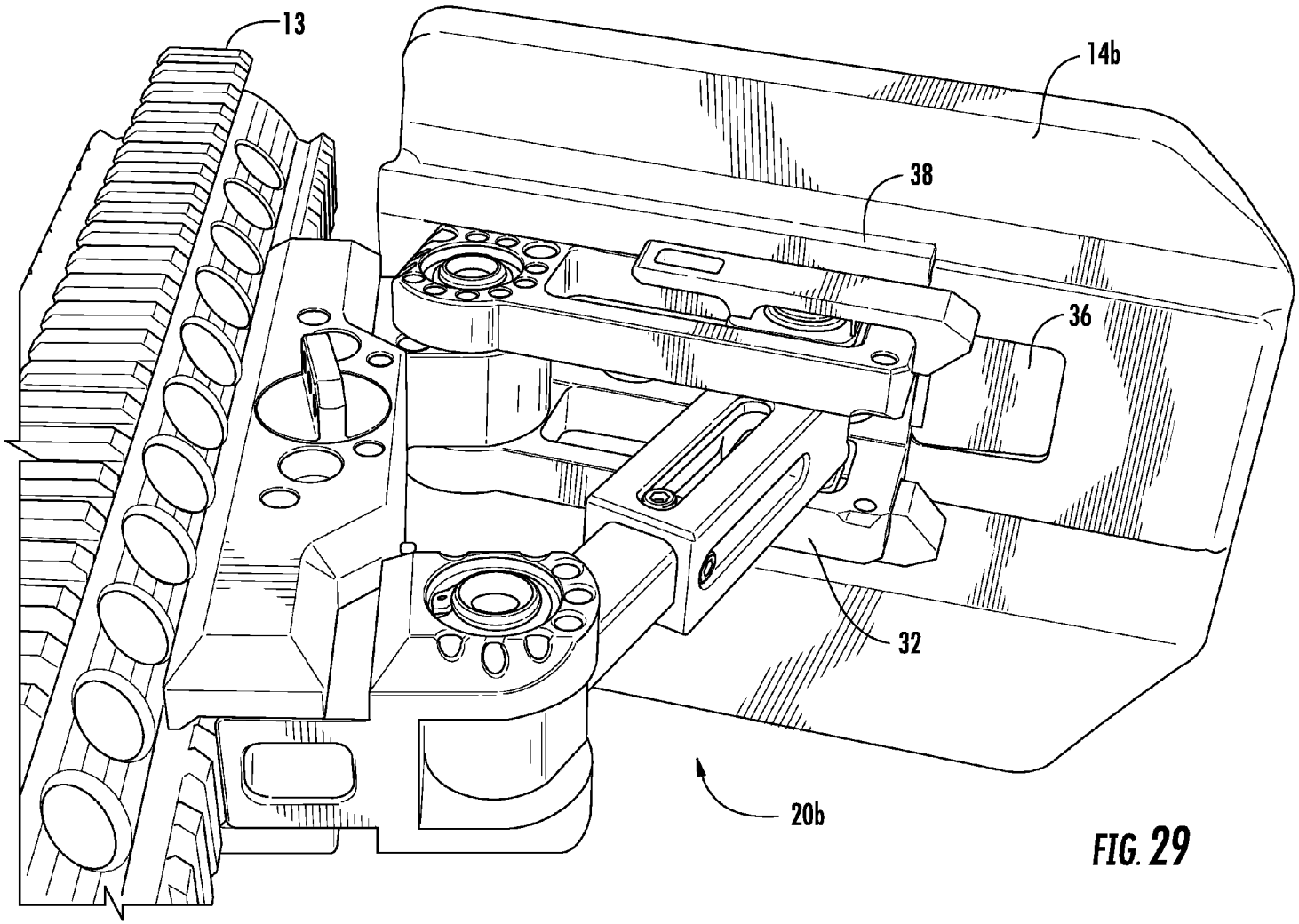
Figure 30:
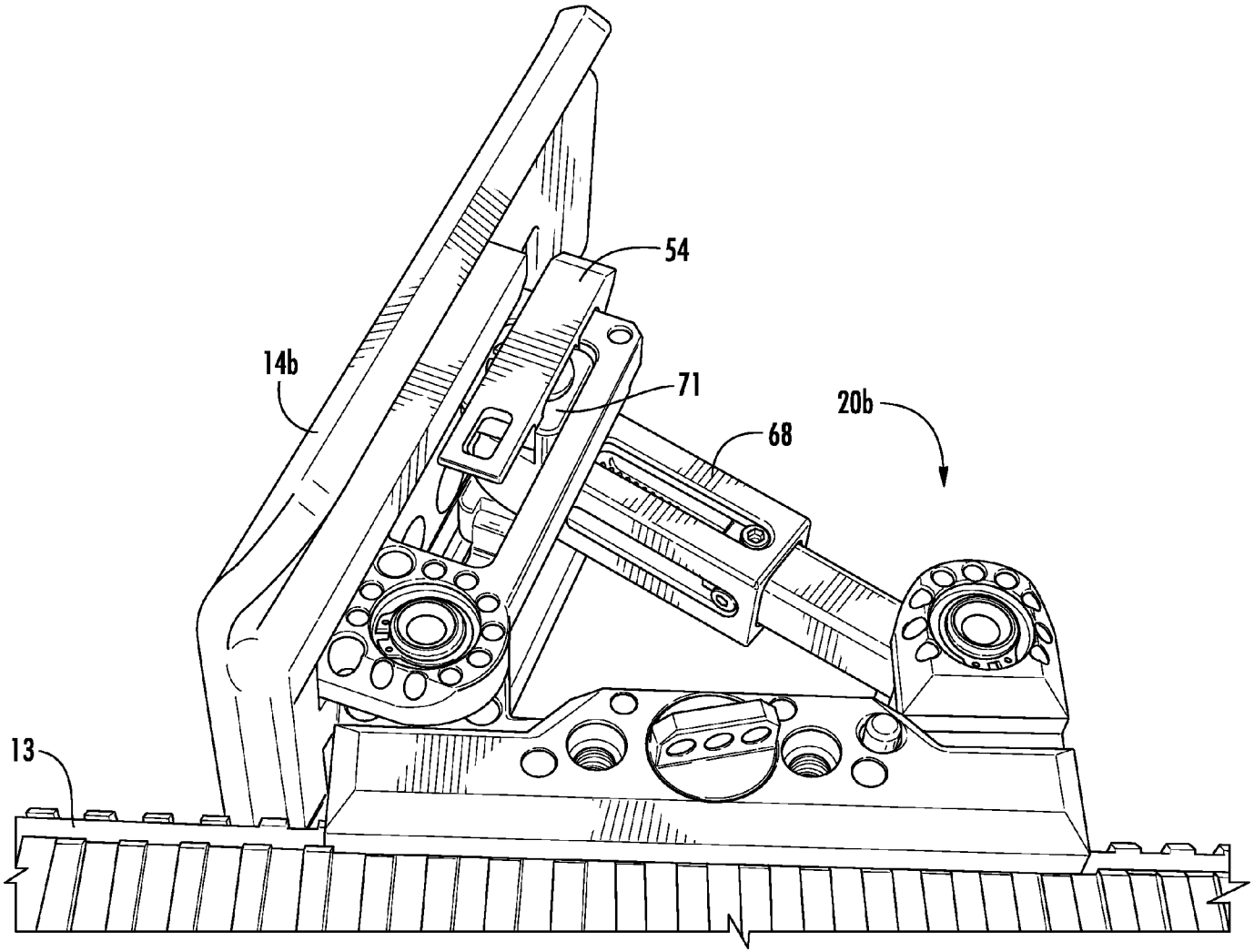
Figure 31:
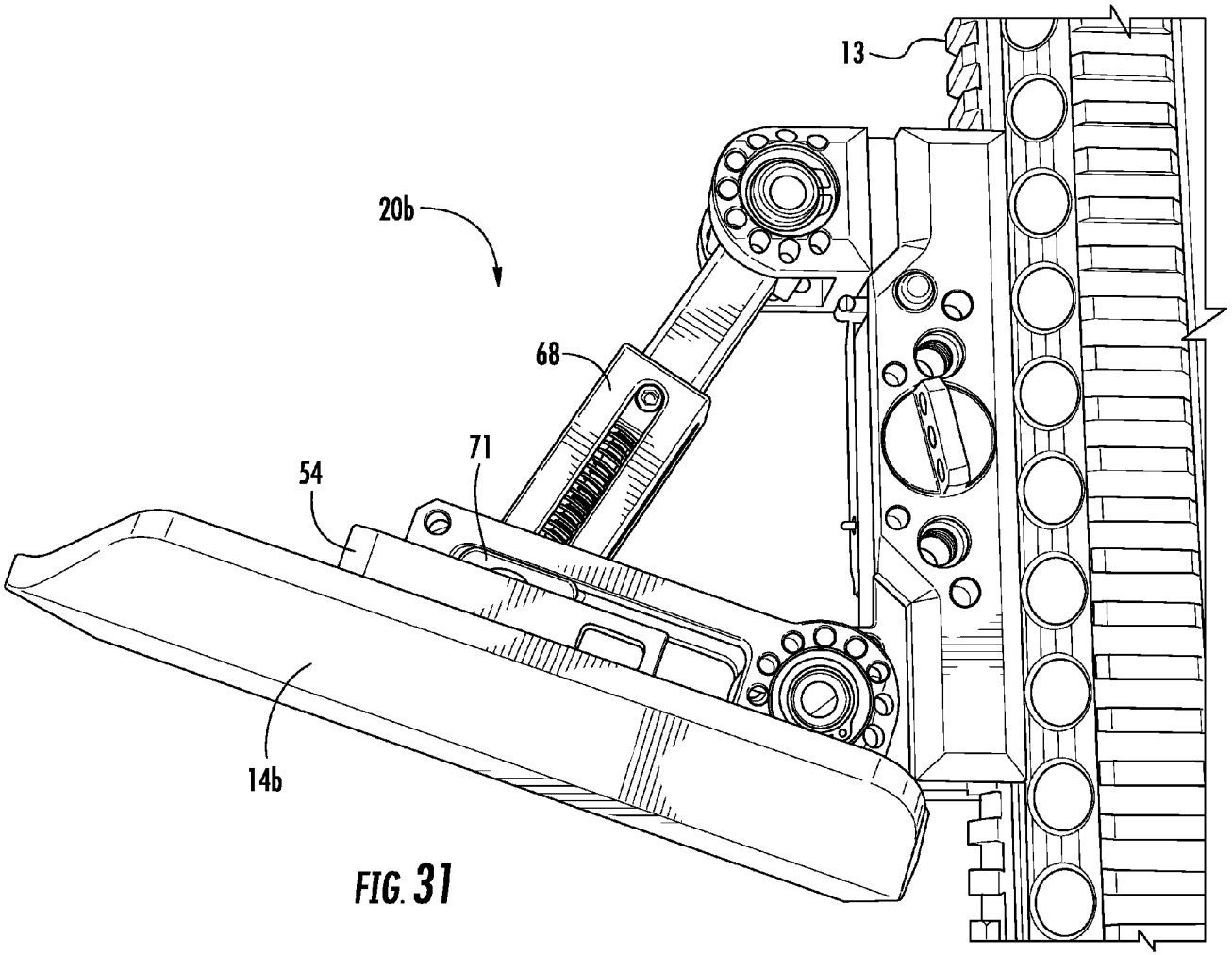
Figure 32A:
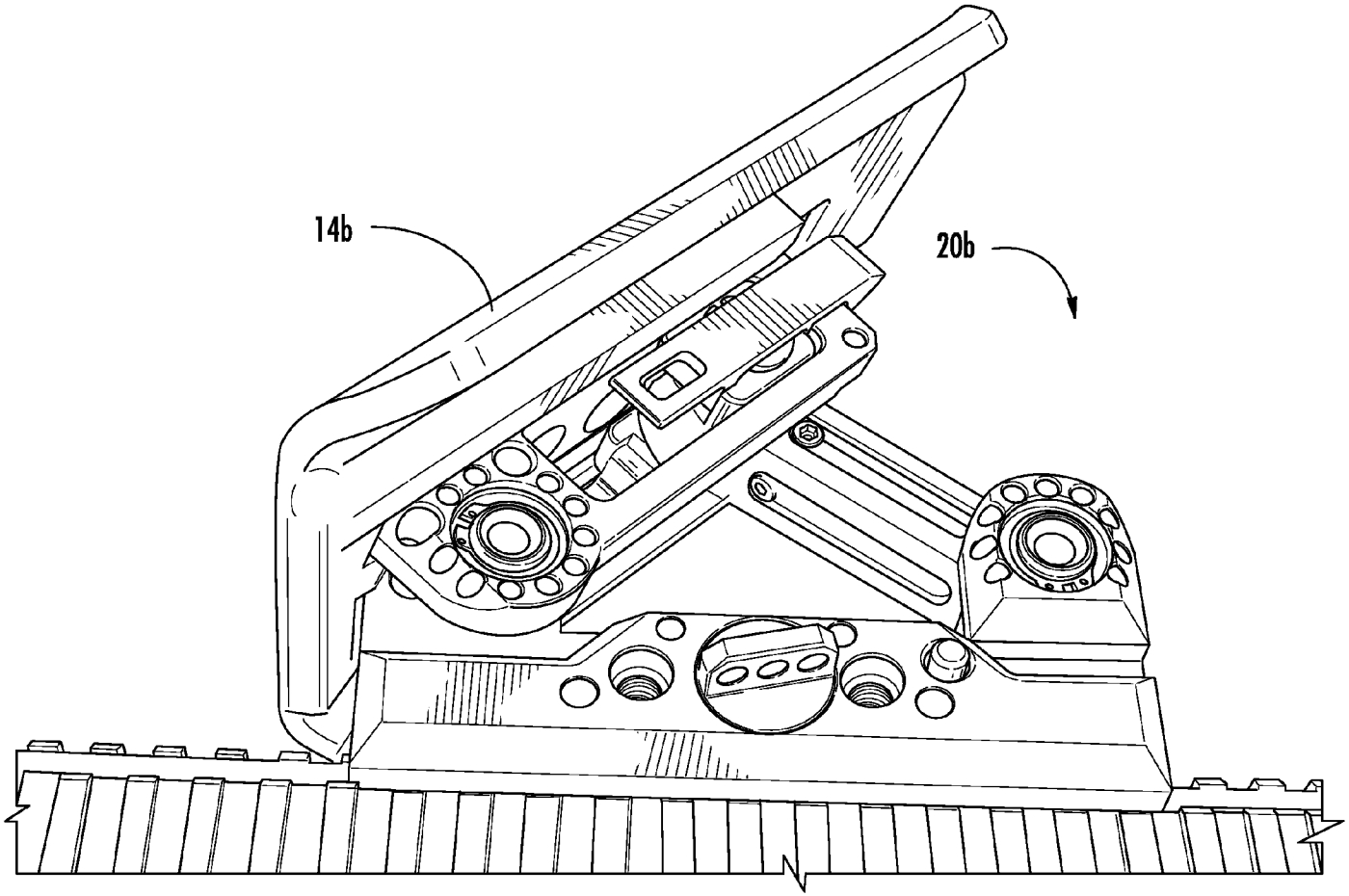
Figure 32B:
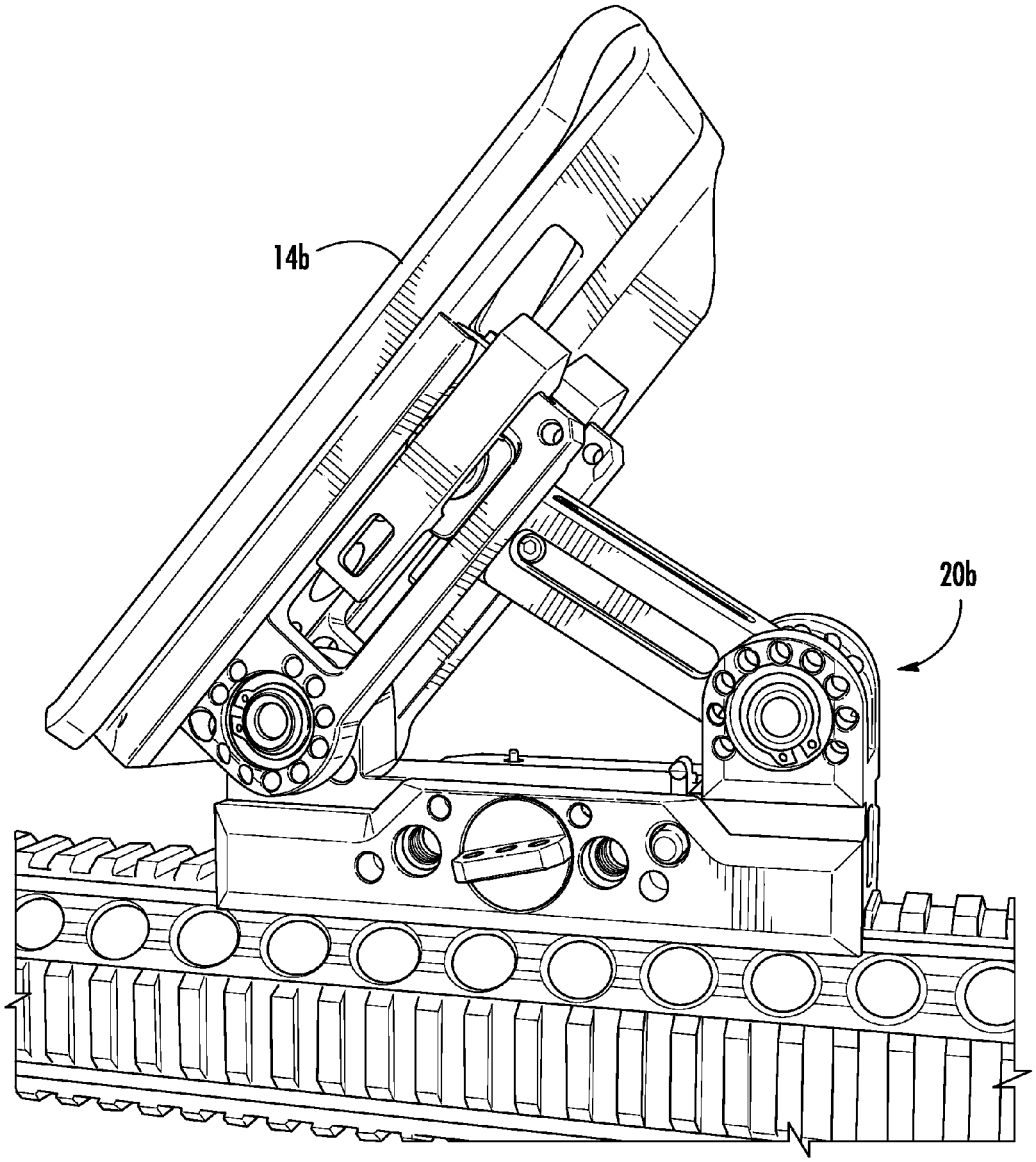

FIGS. 27-32B are various views of a mounting assembly 20*b* in the extended position, according to various embodiments. In general, FIGS. 27-32B depict the mirror image of mounting assembly 20*a* shown in FIGS. 5-6. In FIG. 27, the retracted position retention latch 41 (e.g., attached to the release button 40 as described above) is shown to the left of the thumb screw 74 that is used to clamp the mounting assembly 20*b* to the quad-rail (e.g., barrel rail assembly 13). In FIG. 28, a small nipple 76 is also shown to the right of the thumb screws, according to one embodiment. The nipple 76 may be spring-loaded to put pressure on the system when it is closed, so that when the retracted position latch 41 is released, the system will pop open with assistance from the shock assembly. As shown in FIG. 29, the ballistic plate 14*b* may include a locking mechanism as an extension of the plate retainer 38. For example, as shown to the right of the second portion 32 of the mount, the ballistic panel 14*b* may include a spring-loaded locking mechanism 36 that locks the ballistic plate 14*b* into place on the mount assembly 20*b*. The locking mechanism 36 may be depressed, allowing the ballistic plate 14 to slidably decouple from the mount assembly 20*b*. In FIGS. 30-31, the slide guide 71 can be seen between the top of the shock sleeve 68 and underneath the open-position retention clip 54. FIGS. 32A-32B show a right side of the mount assembly 20*b* in the "impacted" position (e.g., an intermediary position between the fully extended position and the retracted position). This may provide a limit to how far back the system will collapse when a bullet impacts the system while in the extended position.

Figure 33:
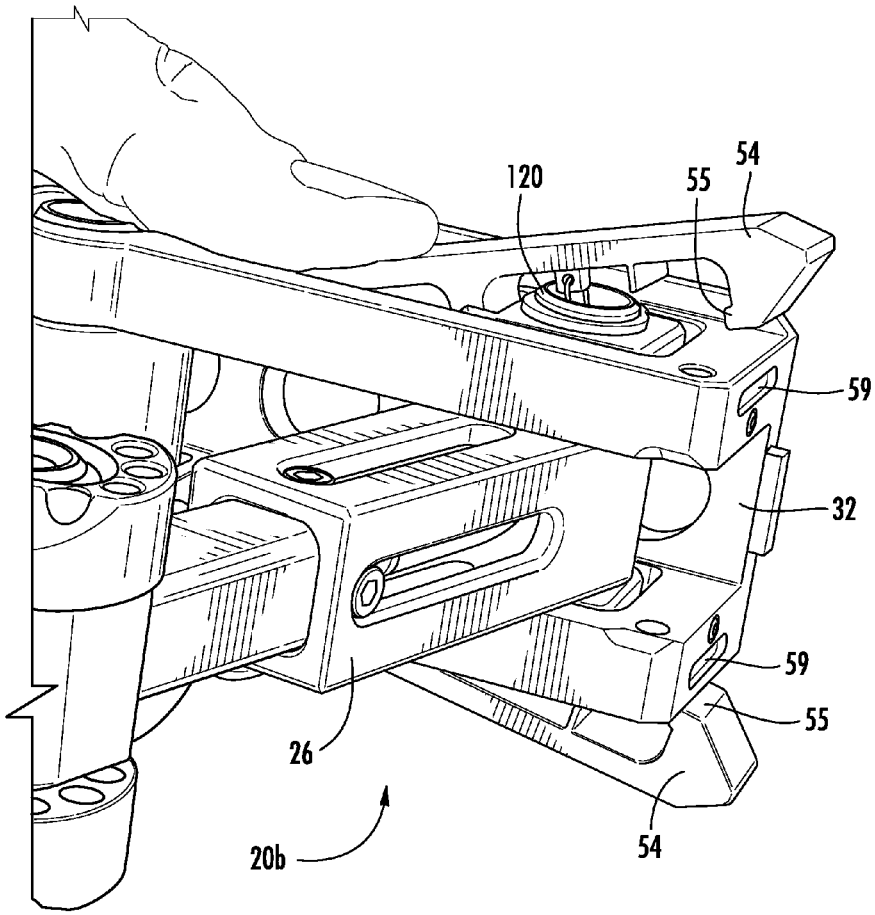
FIG. 33 is an image of flexor arm clips being disengaged from a second portion of a mount assembly, according to an exemplary embodiment.

FIG. 33 is an image of flexor arm clips 54 being disengaged from a second portion 32 of a mount assembly 20*b*, according to an exemplary embodiment. As described previously, flexor arm assembly 26 may include a pivot 120 allowing slide guides 71 to slide between two locations in a channel of second portion 32. During extension of the mount assembly 20*b*, teeth 55 of clips 54 may engage grooves 59 on second portion 32, thereby locking mount assembly 20*b* into its extended position. To return the mount assembly 20*b* to its closed position, clips 54 may be depressed, thereby releasing the flexor arm assembly 26 from the second portion 32.

Figure 34:
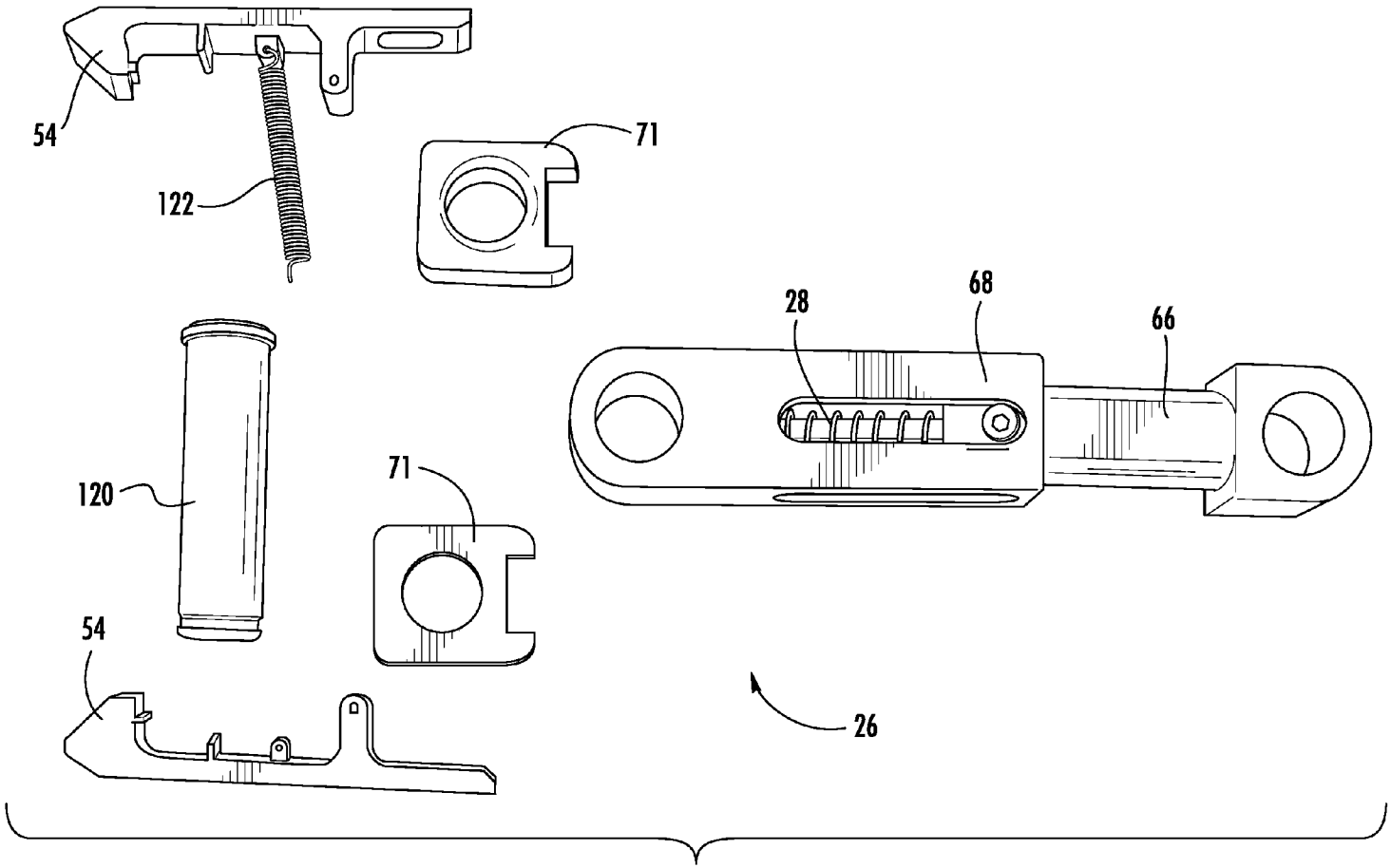
FIG. 34 is an image illustrating the parts of a flexor arm assembly, according to an exemplary embodiment.
Figure 35:
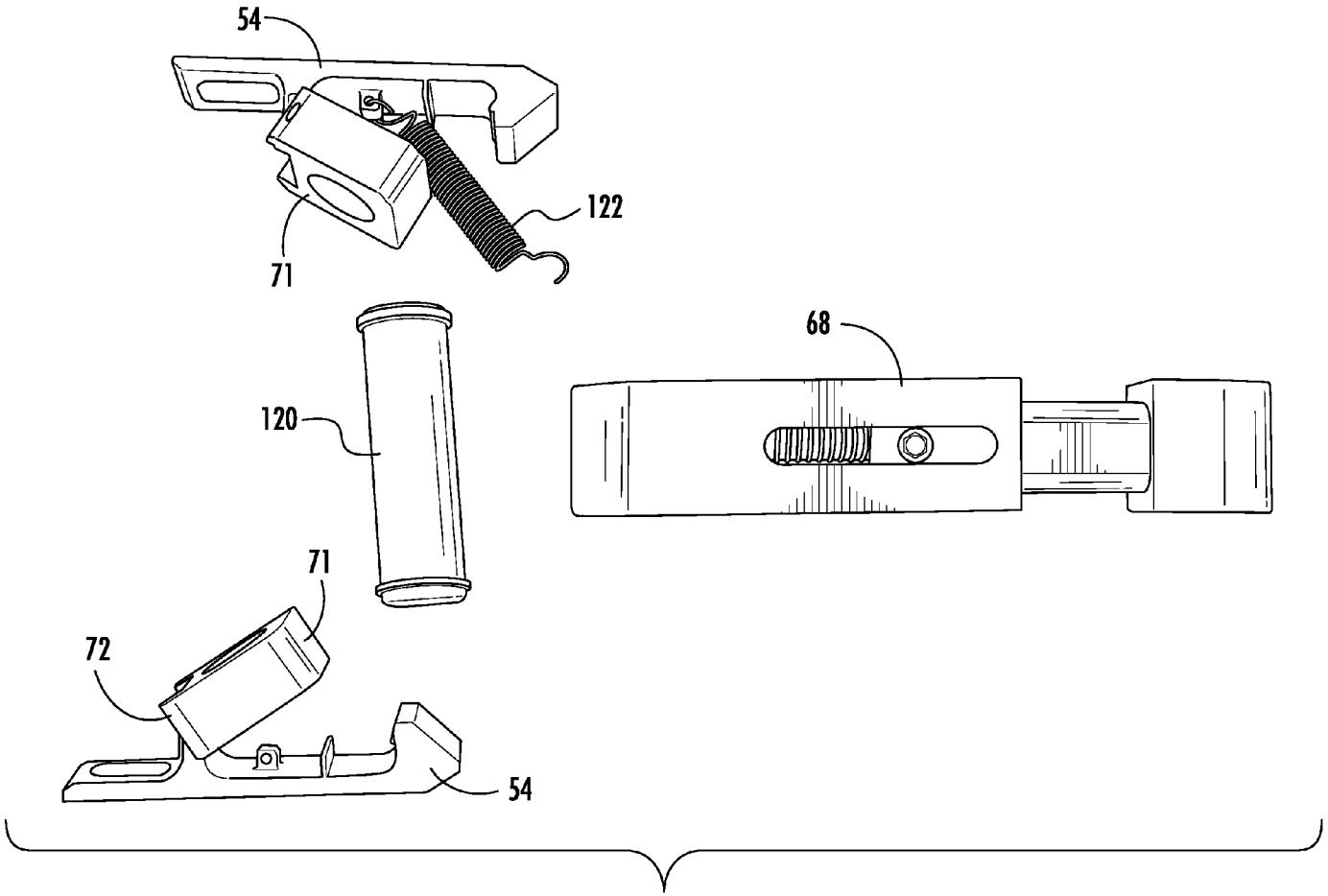
FIG. 35 is another image illustrating the parts of the flexor arm assembly, according to an exemplary embodiment.

Referring now to FIGS. 34-35, image depicting the parts of flexor arm assembly 26 are shown, according to exemplary embodiments. The flexor arm assembly 26 includes the shock absorber 28, external flexor arm 68 and internal flexor arm 66 as described previously in the present disclosure. Slide guides 71 may be placed on either end of the external flexor arm 68 and held in place by pivot 120, according to various embodiments. The two clips 54 may then be attached to the slide guides 71 with pins 72 and retained in the closed position by a spring 122 that is inserted through pivot 120 and attached to clips 54, as show in FIG. 35. When flexor arm assembly 26 is assembled, spring 122 provides force on clips 54, thereby causing clips 54 to clamp together. Depression of clamps 54 (e.g., as shown in FIG. 33) overcomes the force of spring 122, thereby disengaging the clamps 54 from the second portion 32.

Figure 36:
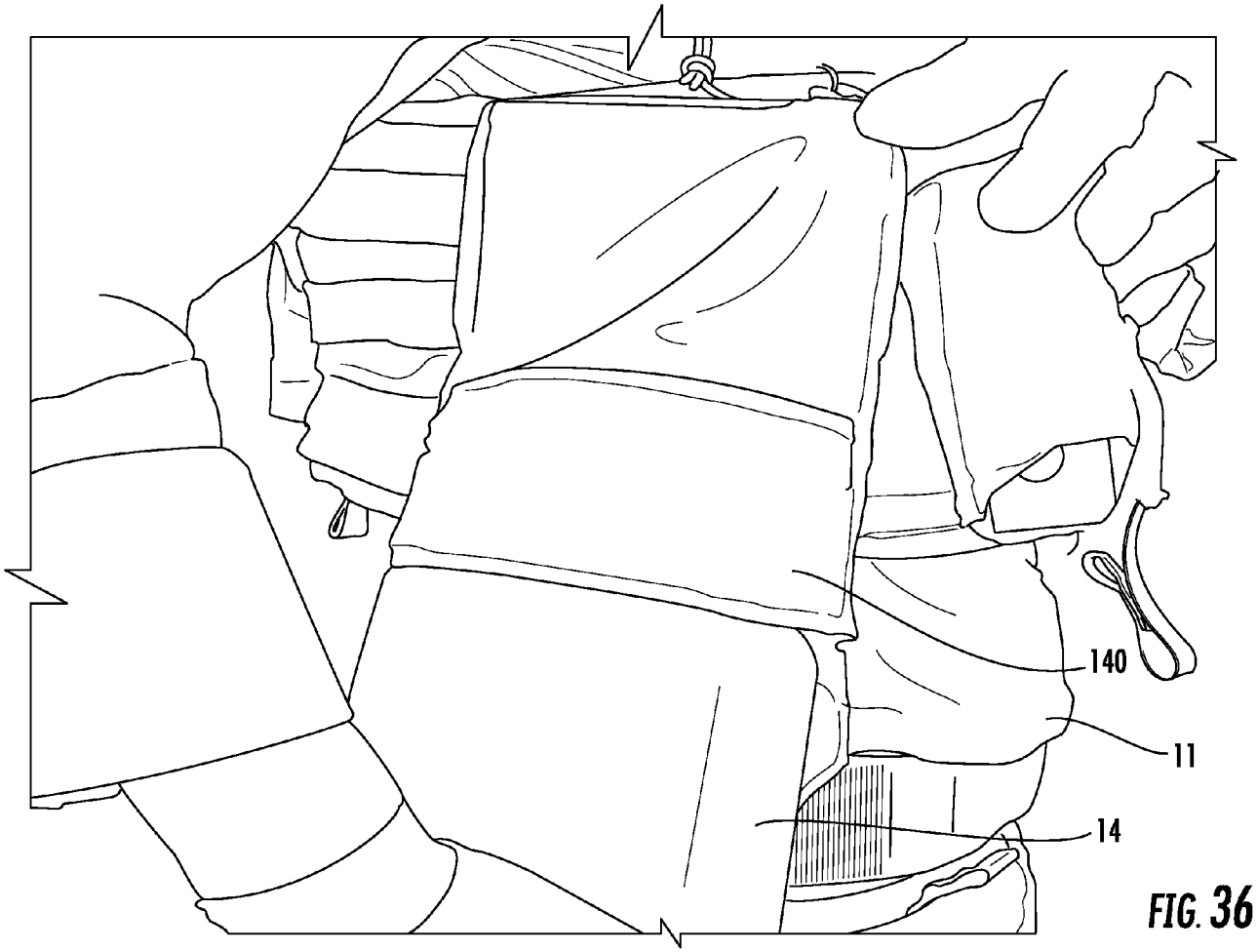
FIG. 36 is an image of a ballistic plate of the shield illustrated in FIG. 2 being inserted into a vest worn by a user, according to an exemplary embodiment.
Figure 37:
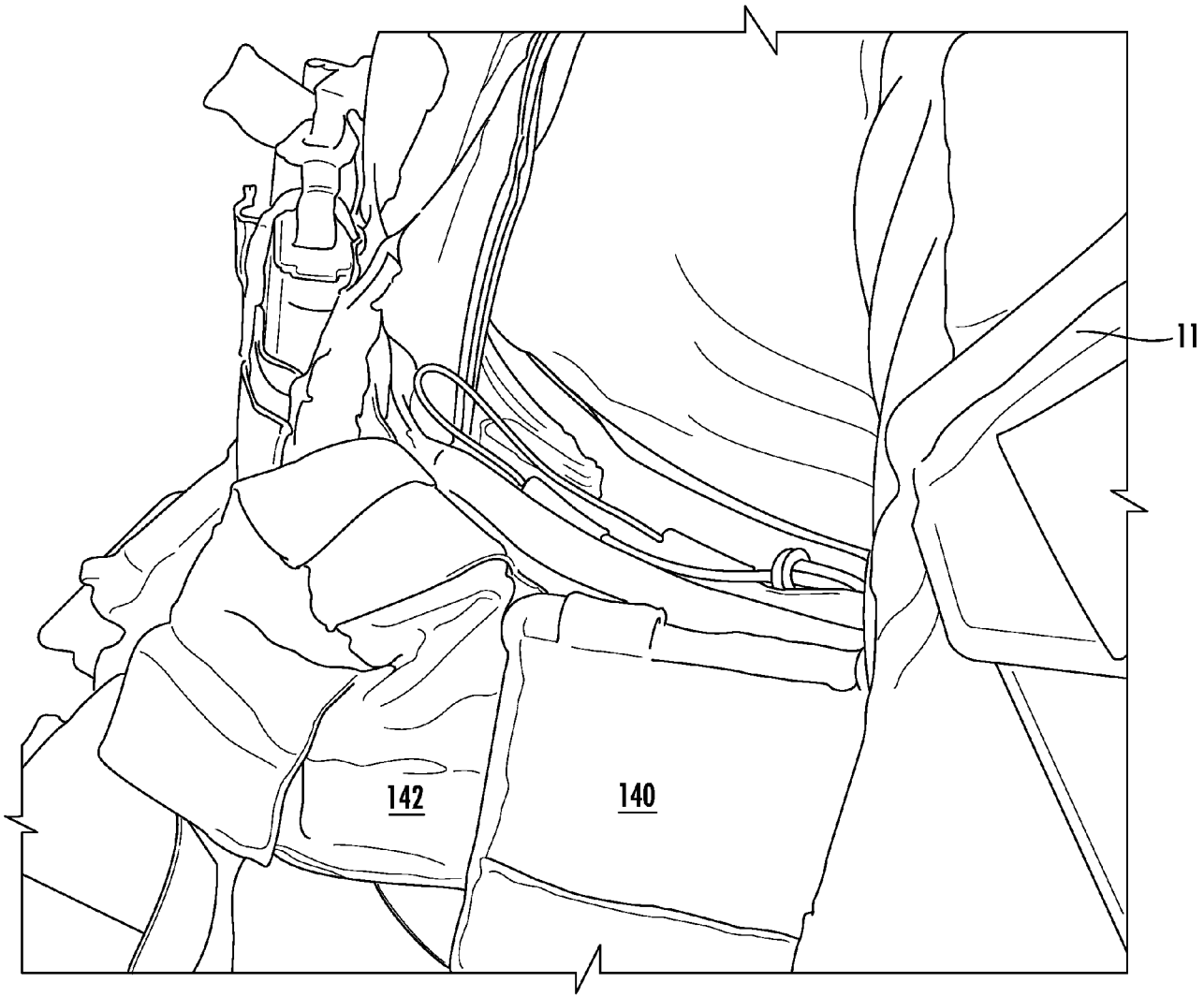
FIG. 37 is an image of the components of the shield illustrated in FIG. 2 being carried by a user, according to an exemplary embodiment.
Figure 38:
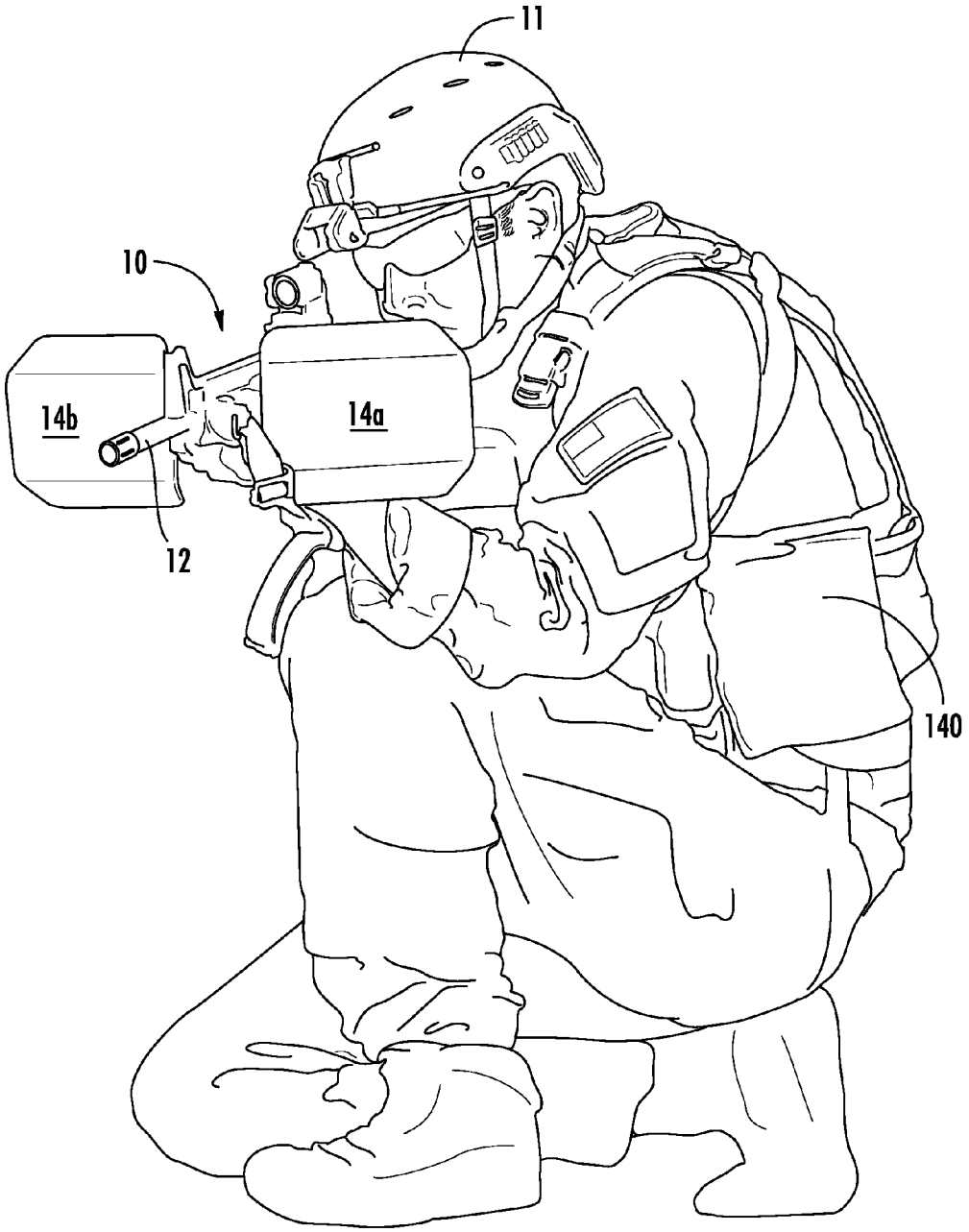
FIG. 38 is an image of a user deploying the shield illustrated in FIG. 2, according to an exemplary embodiment.

Referring now to FIGS. 36-38, images are shown of the components of shield 10 being carried on the person of user 11, according to various embodiments. The modular nature of shield 10 allows the ballistic plates 14 and mount assemblies 20 of shield 10 to be quickly attached and detached from a weapon. When not in use, user 11 may wear the components of shield 10 on his person through the use of pouches or similar mechanisms to transport shield 10 such that the effect on the mobility of user 11 is minimized. As shown in FIG. 36, user 11 may wear a pouch 140 configured to receive and store one or more of ballistic plates 14, when shield 10 is not in use. Pouch 140 may provide some level of protection to user 11 when the one or more ballistic plates 14 are being stored. In FIG. 37, a pouch 142 may also be worn by user 11 to store one or more of mount assemblies 20. In one embodiment, pouches 140, 142 may store all of the components of shield 10 when not in use. In FIG. 38, user 11 is shown with shield 10 deployed, thereby protecting portions of user 11 while aiming weapon 12. When user 11 is done using shield 10, he may choose to remove ballistic plates 14*a*, 14*b* from their respective mount assemblies 20 (not shown) and store ballistic plates 14 in pouch 140. Similarly, user 11 may choose to remove the mount assemblies 20 from weapon 12 and store them in pouch 142.

According to one exemplary embodiment, the shield of the present disclosure may be fitted to a military standard MIL-DTL-1913 rail system, for example. One panel may be installed on either side of the rail, or on both sides. Other weapon mounts may be utilized for weapons without rails.

The shield and its components may be made of various materials. In some exemplary embodiments, the first portion and the second portion of the mount may be made of aluminum and the ballistic shield may be steel, ceramic, or any other high-strength material.

The shield described in the present disclosure may be configured to have multi-hit capacity. In other words, the shield maintains full functionality, meaning the energy absorbing characteristics of the shield are not diminished with each additional projectile impacting the shield.

The construction and arrangement of the shield as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

What is claimed is:

1. A personal protection shield for use with a firearm having a barrel, comprising:

a ballistic plate; and a mount for the ballistic plate comprising a first portion configured to be attached to the firearm substantially parallel to the barrel and comprising a second portion configured to rotate between a retracted position and an extended position about an axis that is substantially perpendicular to the barrel, wherein a side of the second portion is substantially parallel to the barrel in the retracted position, and wherein the ballistic plate is configured to be releasably coupled to the second portion, wherein the first portion comprises a barrel rail retainer configured to engage a barrel rail and configured to attach to the barrel rail by applying compressive force to opposing ends of the barrel rail.

2. The personal protection shield of claim 1, wherein the second portion comprises a plate rail and the ballistic plate comprises a plate rail retainer configured to slidably engage the plate rail.

3. The personal protection shield of claim 1, wherein the ballistic plate comprises contouring configured to deflect a projectile away from the firearm.

4. The personal protection shield of claim 1, wherein the mount for the ballistic plate further comprises a flexor arm coupled to the first portion and coupled to the second portion, wherein the flexor arm is configured to extend when the second portion is moved to the extended position, and wherein the flexor arm is configured to retract when the second portion is moved to the retracted position.

5. The personal protection shield of claim 4, wherein the flexor arm comprises a shock absorber.

6. The personal protection shield of claim 5, wherein the flexor arm is configured to rotate about an axis substantially perpendicular to the barrel at a coupling of the flexor arm and the first portion, wherein a side of the flexor arm is substantially parallel to the first portion when the second portion is in the retracted position.

7. The personal protection shield of claim 6, wherein the flexor arm comprises a locking mechanism configured to retain the flexor arm to the side of the second portion when the second portion is in the extended position.

8. The personal protection shield of claim 1, wherein the barrel rail retainer comprises an upper portion configured to engage an end of the barrel rail, a lower portion configured to engage the opposing end of the barrel rail, and one or more fasteners connecting the upper and lower portions, wherein the one or more fasteners are configured to apply adjustable compression between the upper and lower portions.

9. The personal protection shield of claim 8, further comprising a middle connector mating with the barrel rail.

10. The personal protection shield of claim 1, wherein the side of the second portion forms an angle that is less than perpendicular with the first portion in the extended position.

11. The personal protection shield of claim 10, wherein the side of the second portion forms an angle of approximately less than seventy degrees with the first portion when the second portion is in the extended position.

12. The personal protection shield of claim 1, wherein the first portion and the second portion of the mount for the ballistic plate comprise aluminum.

13. The personal protection shield of claim 1, wherein the ballistic plate comprises steel.

14. The personal protection shield of claim 1, further comprising:

a second ballistic plate; and a second mount for the ballistic plate comprising a first portion configured to be attached to the firearm substantially parallel to the barrel and opposite that of the first mount, wherein the second mount also comprises a second portion configured to rotate between a retracted position and an extended position about an axis that is substantially perpendicular to the barrel, wherein a side of the second portion of the second mount is substantially parallel to the barrel in the retracted position and forms an angle that is less than perpendicular with the first portion of the second mount in the extended position, and wherein the second ballistic plate is configured to be releasably coupled to the second portion of the second mount.

15. The personal protection shield of claim 14, wherein the second portion of the second mount comprises a second plate rail and the second ballistic plate comprises a second plate rail retainer configured to engage the second plate rail.

16. The personal protection shield of claim 14, wherein the second ballistic plate comprises contouring configured to deflect a projectile away from the firearm.

17. The personal protection shield of claim 14, wherein the side of the second portion of the second mount forms an angle of approximately less than seventy degrees with the first portion of second mount when the second portion of the second mount is in the extended position.

18. The personal protection shield of claim 14, wherein the first portion of the second mount comprises a second barrel rail retainer configured to engage a second barrel rail and configured to attach to the second barrel rail by applying compressive force to opposing ends of the second barrel rail.

19. A personal protection shield for a firearm having a barrel, comprising:

a barrel rail assembly comprising an aperture configured to receive the barrel of the firearm, wherein the barrel rail assembly further comprises opposing first and second barrel rails;

a first ballistic plate;

a first mount configured to attach to the first barrel rail and configured to releasably couple with the first ballistic plate;

a second ballistic plate; and a second mount configured to attach to the second barrel rail and configured to releasably couple with the second ballistic plate.

20. The personal protection shield of claim 19, wherein the first mount is configured to open from a retracted position to an extended position, wherein the first ballistic plate is approximately parallel to the first barrel rail when the first mount is in the retracted position and forms an angle that is less than perpendicular when the first mount is in the extended position.

21. The personal protection shield of claim 19, wherein the first mount and the second mount have a total weight of less than five pounds.

22. A mount for a personal protection shield for a firearm having a barrel, comprising:

a first portion configured to engage a barrel rail substantially parallel to the barrel of the firearm and configured to attach to the barrel rail by applying compressive force to opposing ends of the barrel rail; and a second portion configured to rotate between a retracted position and an extended position about an axis that is substantially perpendicular to the barrel, wherein a side of the second portion is substantially parallel to the barrel when in the retracted position, and wherein the second portion comprises a panel rail configured to engage a panel rail retainer of a ballistic plate.

23. The mount of claim 22, wherein the mount comprises aluminum.

* * * * *